US009232332B2

(12) United States Patent
Ranieri et al.

(10) Patent No.: US 9,232,332 B2
(45) Date of Patent: Jan. 5, 2016

(54) MICROPHONE CALIBRATION

(71) Applicant: Analog Devices, Inc., Norwood, MA (US)

(72) Inventors: Juri Ranieri, Lausanne (CH); David Wingate, Ashland, MA (US); Noah Daniel Stein, Somerville, MA (US)

(73) Assignee: Analog Devices, Inc., Norwood, MA (US)

( * ) Notice: Subject to any disclaimer, the term of this patent is extended or adjusted under 35 U.S.C. 154(b) by 17 days.

(21) Appl. No.: 14/341,998

(22) Filed: Jul. 28, 2014

(65) Prior Publication Data

US 2015/0030164 A1 Jan. 29, 2015

Related U.S. Application Data

(60) Provisional application No. 61/858,750, filed on Jul. 26, 2013.

(51) Int. Cl.
*H04R 29/00* (2006.01)

(52) U.S. Cl.
CPC ..... *H04R 29/005* (2013.01); *H04R 2201/003* (2013.01)

(58) Field of Classification Search
CPC ..... H04R 20/00; H04R 29/001
USPC ..... 381/58
See application file for complete search history.

(56) References Cited

U.S. PATENT DOCUMENTS 8,243,952 B2 8/2012 Thormundsson et al.
8,767,975 B2 * 7/2014 Short ..... G10L 21/02 381/111
2005/0273188 A1 12/2005 Barwicz et al.
2008/0175422 A1 7/2008 Kates
2010/0017205 A1 * 1/2010 Visser ..... G10L 21/02 704/225
2010/0303267 A1 12/2010 Pedersen et al.
2011/0038489 A1 * 2/2011 Visser ..... G10L 21/0216 381/92
2011/0058676 A1 * 3/2011 Visser ..... 381/17
2012/0020485 A1 * 1/2012 Visser ..... H04R 3/005 381/57
2013/0051565 A1 2/2013 Pontoppidan

FOREIGN PATENT DOCUMENTS

JP 2007-096384 A 4/2007

OTHER PUBLICATIONS

International Search Report and Written Opinion issued by the Korean Intellectual Property Office as International Searching Authority for International Application No. PCT/US14/048363 mailed Nov. 7, 2014 (11 pgs.).

* cited by examiner

*Primary Examiner* — Simon King
(74) *Attorney, Agent, or Firm* — Patent Capital Group

(57) ABSTRACT

The disclosed apparatus, systems, and methods provide a calibration technique for calibrating a set of microphones. The disclosed calibration technique is configured to calibrate the microphones with respect to a reference microphone and can be used in actual operation rather than a testing environment. The disclosed calibration technique can estimate both the magnitude calibration factor for compensating magnitude sensitivity variations and the relative phase error for compensating phase delay variations. In addition, the disclosed calibration technique can be used even when multiple acoustic sources are present. The disclosed technique is particularly well suited to calibrating a set of microphones that are omnidirectional and sufficiently close to one another.

20 Claims, 18 Drawing Sheets

MICROPHONE CALIBRATION

CROSS-REFERENCE TO RELATED APPLICATION

This application claims the benefit of the earlier priority date of U.S. Provisional Patent Application No. 61/858,750, entitled "APPARATUS, SYSTEMS, AND METHODS FOR MICROPHONE CALIBRATION," filed on Jul. 26, 2013, which is expressly incorporated herein by reference in its entirety.

BACKGROUND

1. Technical Field

Disclosed apparatus, systems, and methods relate to calibrating microphones in an electronic system.

2. Description of the Related Art

Electronic devices often use multiple microphones to improve a quality of measured acoustic information and to extract information about acoustic sources and/or the surroundings. For example, an electronic device can use signals detected by multiple microphones to separate them based on their sources, which is often referred to as blind source separation. As another example, an electronic device can use signals detected by multiple microphones to suppress reverberations in the detected signals or to cancel acoustic echo from the detected signals.

When processing signals detected by multiple microphones, electronic devices often assume that the microphones have the same magnitude sensitivity and phase error. Unfortunately, microphones often do not have the same magnitude sensitivity and phase error, even when the microphones were created using the same process. Such a process variation is more pronounced in cheap microphones often used in consumer electronics such as smart phones. Because a moderate variance in the magnitude sensitivity and/or phase error can cause a significant error in the above-mentioned applications, there is a need in the art to provide apparatus, systems, and methods for calibrating microphones.

SUMMARY

In the present application, apparatus, systems, and methods are provided for calibrating microphones in an electronic system.

Some embodiments include an apparatus. The apparatus can include an interface configured to receive a first digitized signal stream and a second digitized signal stream, wherein the first digitized signal stream and the second digitized signal stream correspond to an acoustic signal captured by a first microphone and a second microphone, respectively. The apparatus can also include a processor, in communication with the interface, configured to run a module stored in memory. The module can be configured to determine a first time-frequency representation of the first digitized signal stream and a second time-frequency representation of the second digitized signal stream, wherein the first time-frequency representation indicates a magnitude of the first digitized signal stream for a plurality of frequencies at a plurality of time frames, and wherein the second time-frequency representation indicates a magnitude of the second digitized signal stream for the plurality of frequencies for the plurality of time frames; determine a relationship between the first time-frequency representation and the second time-frequency representation at the plurality of time frames for a first of the plurality of frequencies; and determine a magnitude calibration factor between the first microphone and the second microphone for the first of the plurality of frequencies based on the relationship between the first time-frequency representation and the second time-frequency representation.

Some embodiments include a method. The method can include receiving, by a data processing module coupled to a first microphone and a second microphone, a first digitized signal stream and a second digitized signal stream, wherein the first digitized signal stream and the second digitized signal stream correspond to an acoustic signal captured by the first microphone and the second microphone, respectively. The method can also include determining, by the data processing module, a first time-frequency representation of the first digitized signal stream and a second time-frequency representation of the second digitized signal stream, wherein the first time-frequency representation indicates a magnitude of the first digitized signal stream for a plurality of frequencies at a plurality of time frames, and wherein the second time-frequency representation indicates a magnitude of the second digitized signal stream for the plurality of frequencies for the plurality of time frames. The method can further include determining, by a calibration module in communication with the data processing module, a relationship between the first time-frequency representation and the second time-frequency representation at the plurality of time frames for a first of the plurality of frequencies. The method can additionally include determining, by the calibration module, a magnitude calibration factor between the first microphone and the second microphone for the first of the plurality of frequencies based on the relationship between the first time-frequency representation and the second time-frequency representation.

Some embodiments include a non-transitory computer readable medium. The non-transitory computer readable medium can include executable instructions operable to cause a data processing apparatus to receive, over an interface coupled to a first microphone and a second microphone, a first digitized signal stream and a second digitized signal stream, wherein the first digitized signal stream and the second digitized signal stream correspond to an acoustic signal captured by the first microphone and the second microphone, respectively. The computer readable medium can also include executable instructions operable to cause the data processing apparatus to determine a first time-frequency representation of the first digitized signal stream and a second time-frequency representation of the second digitized signal stream, wherein the first time-frequency representation indicates a magnitude of the first digitized signal stream for a plurality of frequencies at a plurality of time frames, and wherein the second time-frequency representation indicates a magnitude of the second digitized signal stream for the plurality of frequencies for the plurality of time frames. The computer readable medium can also include executable instructions operable to cause the data processing apparatus to determine a relationship between the first time-frequency representation and the second time-frequency representation at the plurality of time frames for a first of the plurality of frequencies, and determine a magnitude calibration factor between the first microphone and the second microphone for the first of the plurality of frequencies based on the relationship between the first time-frequency representation and the second time-frequency representation.

In some embodiments, the apparatus, the method, and/or the non-transitory computer readable medium can include a module, a step or executable instructions for determining, for the first of the plurality of frequencies, ratios of the second time-frequency representation to the first time-frequency representation for each of the plurality of time frames, and determining a histogram of the ratios corresponding to the first of the plurality of frequencies.

In some embodiments, the apparatus, the method, and/or the non-transitory computer readable medium can include a module, a step or executable instructions for determining the magnitude calibration factor based on a count of the ratios in the histogram.

In some embodiments, the apparatus, the method, and/or the non-transitory computer readable medium can include a module, a step or executable instructions for determining a plurality of magnitude calibration factors corresponding to a plurality of frequencies based on a plurality of histograms, wherein the plurality of histograms corresponds to the plurality of frequencies, respectively; and smoothing magnitude calibration factors associated with at least two of the plurality of frequencies.

In some embodiments, the apparatus, the method, and/or the non-transitory computer readable medium can include a module, a step or executable instructions for identifying a ratio with the highest count in the histogram.

In some embodiments, the apparatus, the method, and/or the non-transitory computer readable medium can include a module, a step or executable instructions for identifying a line that models the relationship between the first time-frequency representation and second time-frequency representation corresponding to the plurality of time frames and the first of the plurality of frequencies.

In some embodiments, the apparatus, the method, and/or the non-transitory computer readable medium can include a module, a step or executable instructions for multiplying the first time-frequency representation for the first of the plurality of frequencies with the magnitude calibration factor for the first of the plurality of frequencies to calibrate the first microphone with respect to the second microphone.

In some embodiments, the apparatus, the method, and/or the non-transitory computer readable medium can include a module, a step or executable instructions for receiving a first additional digitized signal of the first digitized signal stream corresponding to the acoustic signal captured by the first microphone at a first time frame; receiving a second additional digitized signal of the second digitized signal stream corresponding to the acoustic signal captured by the second microphone at the first time frame; computing a third time-frequency representation based on the first additional digitized signal; computing a fourth time-frequency representation based on the second additional digitized signal; and updating the magnitude calibration factor based on the third time-frequency representation and the fourth time-frequency representation.

In some embodiments, the apparatus, the method, and/or the non-transitory computer readable medium can include a module, a step or executable instructions for identifying a frequency at which the magnitude of the third time-frequency representation at the first time frame is below a noise level, and discarding the third time-frequency representation for the identified frequency and the first time frame when updating the magnitude calibration factor based on the third time-frequency representation.

In some embodiments, the apparatus, the method, and/or the non-transitory computer readable medium can include a module, a step or executable instructions for identifying a frequency at which the third time-frequency representation at the first time frame is associated with a non-conforming acoustic signal; and discarding the third time-frequency representation for the identified frequency and the first time frame when updating the magnitude calibration factor based on the third time-frequency representation.

In some embodiments, the apparatus, the method, and/or the non-transitory computer readable medium can include a module, a step or executable instructions for determining that the third time-frequency representation is associated with the non-conforming acoustic signal when a ratio of the fourth time-frequency representation and the third time-frequency representation is sufficiently different from the magnitude calibration factor computed based on the first time-frequency representation and the second time-frequency representation.

In some embodiments, the time-frequency representation comprises one or more of a short-time Fourier transform (STFT) or a wavelet transform.

In some embodiments, the apparatus can include an interface configured to receive a first digitized signal stream and a second digitized signal stream, wherein the first digitized signal stream and the second digitized signal stream correspond to an acoustic signal captured by a first microphone and a second microphone, respectively. The apparatus can also include a processor, in communication with the interface, configured to run a module stored in memory. The module can be configured to determine a first time-frequency representation of the first digitized signal stream and a second time-frequency representation of the second digitized signal stream, wherein the first time-frequency representation indicates a phase of the first digitized signal stream for a plurality of frequencies and for a first time frame, and wherein the second time-frequency representation indicates a phase of the second digitized signal stream for the plurality of frequencies and for the first time frame. The module can also be configured to compute a first parameter that indicates a direction of arrival of the acoustic signal based on a relative arrangement of the first microphone and the second microphone, and the first time-frequency representation and the second time-frequency representation at a first of the plurality of frequencies at the first time frame. The module can also be configured to determine a first relative phase error between the first microphone and the second microphone for the first time frame for the first of the plurality of frequencies based on the first parameter, the first time-frequency representation, and the second time-frequency representation at the first of the plurality of frequencies at the first time frame.

In some embodiments, the method can include receiving, by a data processing module coupled to a first microphone and a second microphone, a first digitized signal stream and a second digitized signal stream, wherein the first digitized signal stream and the second digitized signal stream correspond to an acoustic signal captured by the first microphone and the second microphone, respectively. The method can also include determining, at the data processing module, a first time-frequency representation of the first digitized signal stream and a second time-frequency representation of the second digitized signal stream, wherein the first time-frequency representation indicates a phase of the first digitized signal stream for a plurality of frequencies and for a first time frame, and wherein the second time-frequency representation indicates a phase of the second digitized signal stream for the plurality of frequencies and for the first time frame. The method can further include computing, at a calibration module in communication with the data processing module, a first parameter that indicates a direction of arrival of the acoustic signal based on a relative arrangement of the first microphone and the second microphone, and the first time-frequency representation and the second time-frequency representation at a first of the plurality of frequencies at the first time frame. The method can also include determining, at the calibration module, a first relative phase error between the first microphone and the second microphone for the first time frame for the first of the plurality of frequencies based on the first parameter, the first time-frequency representation, and the second time-frequency representation at the first of the plurality of frequencies at the first time frame.

In some embodiments, the non-transitory computer readable medium can include executable instructions operable to cause a data processing apparatus to receive, over an interface coupled to a first microphone and a second microphone, a first digitized signal stream and a second digitized signal stream, wherein the first digitized signal stream and the second digitized signal stream correspond to an acoustic signal captured by the first microphone and the second microphone, respectively. The computer readable medium can also include executable instructions operable to cause the data processing apparatus to determine a first time-frequency representation of the first digitized signal stream and a second time-frequency representation of the second digitized signal stream, wherein the first time-frequency representation indicates a phase of the first digitized signal stream for a plurality of frequencies and for a first time frame, and wherein the second time-frequency representation indicates a phase of the second digitized signal stream for the plurality of frequencies and for the first time frame. The computer readable medium can also include executable instructions operable to cause the data processing apparatus to compute a first parameter that indicates a direction of arrival of the acoustic signal based on a relative arrangement of the first microphone and the second microphone, and the first time-frequency representation and the second time-frequency representation at a first of the plurality of frequencies at the first time frame. The computer readable medium can further include executable instructions operable to cause the data processing apparatus to determine a first relative phase error between the first microphone and the second microphone for the first time frame for the first of the plurality of frequencies based on the first parameter, the first time-frequency representation, and the second time-frequency representation at the first of the plurality of frequencies at the first time frame.

In some embodiments, the apparatus, the method, and/or the non-transitory computer readable medium can include a module, a step or executable instructions for determining a first phase difference between the first time-frequency representation and the second time-frequency representation at the first of the plurality of quantized frequencies at the first time frame; and determining the first parameter based on the first phase difference.

In some embodiments, the apparatus, the method, and/or the non-transitory computer readable medium can include a module, a step or executable instructions for determining the first parameter based on a linear system that relates, at least in part, the direction of arrival and the phase difference between the first time-frequency representation and the second time-frequency representation.

In some embodiments, the apparatus, the method, and/or the non-transitory computer readable medium can include a module, a step or executable instructions for receiving a first additional digitized signal of the first digitized signal stream corresponding to the acoustic signal captured by the first microphone at a second time frame; receiving a second additional digitized signal of the second digitized signal stream corresponding to the acoustic signal captured by the second microphone at the second time frame; computing a third time-frequency representation for the second time frame based on the first additional digitized signal; computing a fourth time-frequency representation for the second time frame based on the second additional digitized signal; determining a second parameter that indicates a direction of arrival of the acoustic signal for the second time frame based on the third frequency representation and the fourth frequency representation for the second time frame, the relative arrangement of the first microphone and the second microphone, and the first relative phase error for the first time frame; and determining a second relative phase error between the first microphone and the second microphone for the second time frame for the first of the plurality of frequencies based on the third frequency representation and the fourth frequency representation at the second time frame, and the second parameter.

In some embodiments, the apparatus, the method, and/or the non-transitory computer readable medium can include a module, a step or executable instructions for determining the second relative phase error based on the first relative phase error to smooth the second relative phase error with respect to the first relative phase error.

In some embodiments, the apparatus, the method, and/or the non-transitory computer readable medium can include a module, a step or executable instructions for determining the second relative phase error when the first parameter, which indicates a discretization of the direction of arrival for the first time frame, and the second parameter, which indicates a discretization of the direction of arrival for the second time frame, are close to one another.

In some embodiments, the apparatus, the method, and/or the non-transitory computer readable medium can include a module, a step or executable instructions for providing a mask that identifies a frequency at which a magnitude of the third time-frequency representation is below a noise level.

In some embodiments, the apparatus, the method, and/or the non-transitory computer readable medium can include a module, a step or executable instructions for using the mask to discard the third time-frequency representation for the identified frequency in estimating the second relative phase error.

In some embodiments, the apparatus, the method, and/or the non-transitory computer readable medium can include a module, a step or executable instructions for providing a mask that identifies a frequency at which the third time-frequency representation is associated with a non-conforming acoustic signal.

In some embodiments, the apparatus, the method, and/or the non-transitory computer readable medium can include a module, a step or executable instructions for using the mask to discard the third time-frequency representation for the identified frequency in estimating the second relative phase error.

In some embodiments, the apparatus, the method, and/or the non-transitory computer readable medium can include a module, a step or executable instructions for smoothing the first relative phase error associated with at least two of the plurality of frequencies.

In some embodiments, the apparatus, the method, and/or the non-transitory computer readable medium can include a module, a step or executable instructions for receiving a first additional digitized signal of the first digitized signal stream corresponding to the acoustic signal captured by the first microphone at a second time frame; computing a third time-frequency representation for the second time frame based on the first additional digitized signal; and removing the first relative phase error from the third time-frequency representation for the first of the plurality of frequencies for the second time frame to calibrate the first microphone with respect to the second microphone for the first of the plurality of frequencies.

The disclosed calibration technique, which includes apparatus, systems, and methods, described herein can provide one or more of the following advantages. The disclosed calibration technique can estimate a calibration profile of a microphone online, e.g., when the microphone is deployed in an actual operation. Therefore, the disclosed calibration technique need not be deployed in a testing environment, which may be time consuming and costly. The disclosed calibration technique can also be deployed in an offline session, e.g., during a separate calibration session. The disclosed calibration technique can estimate both the magnitude calibration factor for compensating magnitude sensitivity variations and the relative phase error for compensating phase error variations. In addition, the disclosed calibration technique can be used even when multiple acoustic sources are present. As described below, the disclosed calibration technique can systematically eliminate any bias introduced by multiple acoustic sources, without actively discarding signals from multiple acoustic sources.

There has thus been outlined, rather broadly, the features of the disclosed subject matter in order that the detailed description thereof that follows may be better understood, and in order that the present contribution to the art may be better appreciated. There are, of course, additional features of the disclosed subject matter that will be described hereinafter and which will form the subject matter of the claims appended hereto.

BRIEF DESCRIPTION OF THE DRAWINGS

Various objects, features, and advantages of the disclosed subject matter can be more fully appreciated with reference to the following detailed description of the disclosed subject matter when considered in connection with the following drawings, in which like reference numerals identify like elements.

DETAILED DESCRIPTION

In the following description, numerous specific details are set forth regarding the systems and methods of the disclosed subject matter and the environment in which such systems and methods may operate, etc., in order to provide a thorough understanding of the disclosed subject matter. It will be apparent to one skilled in the art, however, that the disclosed subject matter may be practiced without such specific details, and that certain features, which are well known in the art, are not described in detail in order to avoid complication of the subject matter of the disclosed subject matter. In addition, it will be understood that the examples provided below are exemplary, and that it is contemplated that there are other systems and methods that are within the scope of the disclosed subject matter.

A microphone includes a transducer that is configured to receive an acoustic signal s(t) and convert it into an electrical signal m(t), where t indicates a time variable. Ideally, a microphone has a flat frequency domain transfer function:

$$H(\omega)=A$$

where A is a conversion gain factor. Thus, an ideal microphone receives an acoustic signal and converts it into an electrical signal without any delay, for all frequencies of interest.

Figure 1:
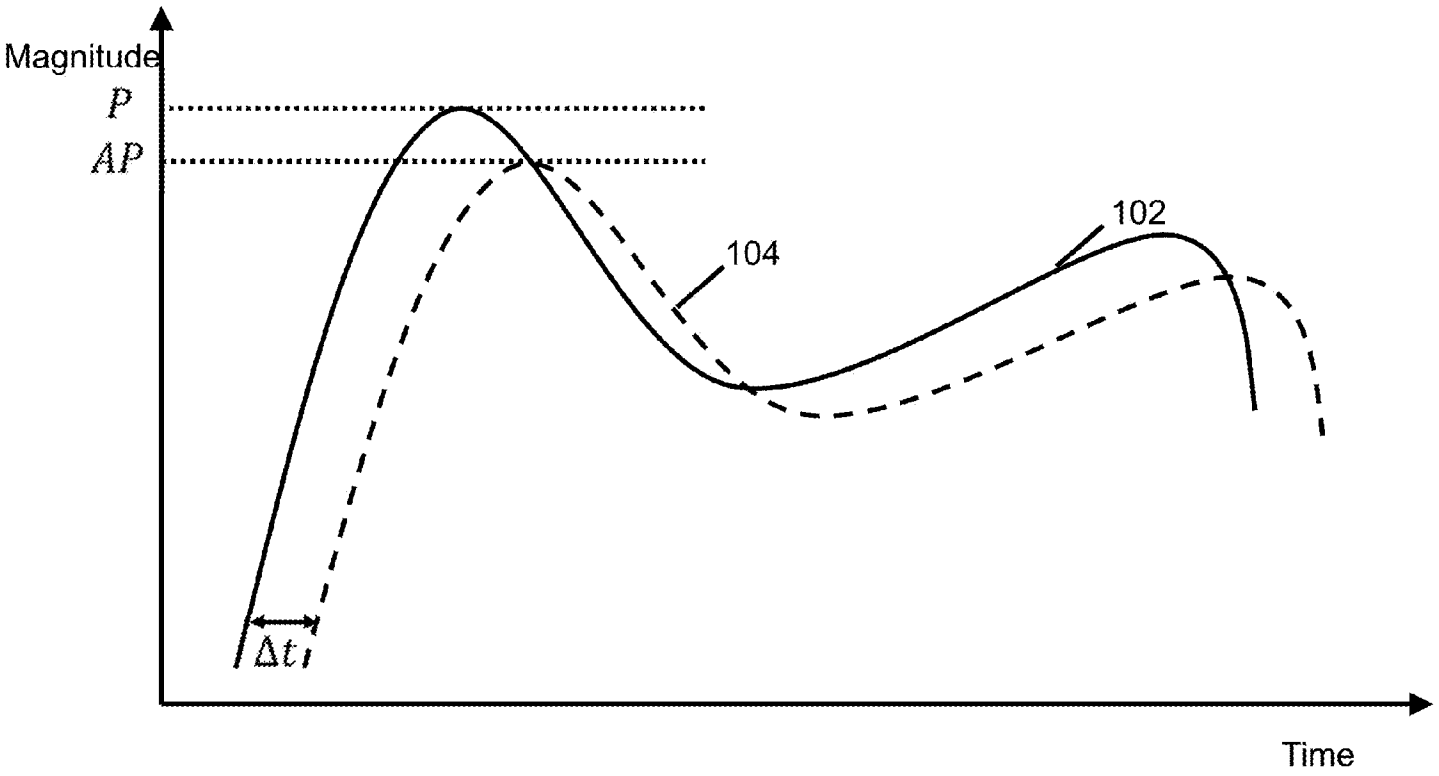
FIG. 1 illustrates a relationship between an input acoustic signal and a detected electrical signal in accordance with some embodiments.

Unfortunately, a typical microphone exhibits certain non-ideal characteristics. For example, a microphone can add a delay to a converted acoustic signal m(t) with respect to the input acoustic signal s(t). FIG. 1 illustrates a relationship between an input acoustic signal s(t) and a detected electrical signal m(t) in accordance with some embodiments. Because of the non-ideal characteristics of the microphone, the detected electrical signal m(t) 104 is delayed with respect to the input acoustic signal s(t) 102 by a delay $\Delta t$.

Furthermore, a microphone's characteristics, such as the conversion gain factor A and/or the delay $\Delta t$, can be frequency-dependent. For example, while a microphone attenuates a 10 KHz acoustic signal by a conversion gain factor of 0.8, the same microphone can attenuate a 15 KHz acoustic signal by a conversion gain factor of 0.7. Likewise, while a microphone delays a 10 KHz acoustic signal by 0.1 ms, the same microphone can delay a 15 KHz acoustic signal by 0.11 ms. Therefore, the transfer function of a non-ideal microphone having a frequency-dependent conversion gain factor and a frequency-dependent delay can be modeled as follows:

$$H(\omega)=A(\omega)\exp(i\phi(\omega)),$$

where $A(\omega)$ indicates a frequency-dependent conversion gain factor; $\phi(\omega)$ indicates the frequency-dependent phase error corresponding to the time delay $\Delta t$; and $i=\sqrt{-1}$.

The non-ideal characteristics of a microphone are not as problematic if all microphones have the same non-ideal characteristics because most applications of multiple microphones assume that microphones are non-ideal, but non-ideal in the same way. However, because of uncontrolled variations in the manufacturing process, different microphones have different characteristics, which can cause error in applications that rely on identical characteristics of microphones.

To address the manufacturing variations, a variety of calibration techniques have been developed to estimate the conversion gain factor $A(\omega)$ and the phase error $\phi(\omega)$ of a microphone. The estimated conversion gain factor and the estimated phase error can be used to remove the effect of microphone's transfer function from the detected signal m(t) by passing it through a compensation filter c(t) having the following transfer function in the frequency domain:

$$C(\omega) = \frac{1}{A(\omega)}\exp(-i\phi(\omega)).$$

This way, the aggregate transfer function of the microphone and the compensation filter is a constant for all frequencies, thereby approximating an ideal microphone:

$$H(\omega)C(\omega) = A(\omega)\exp(i\phi(\omega)) \times \frac{1}{A(\omega)}\exp(-i(\omega)) = 1.$$

One class of calibration techniques is called an offline calibration technique. An offline calibration technique tests a microphone in an anechoic room using a calibrated acoustic source of a known frequency and measures the microphone's response to that calibrated acoustic source. This step can be iterated for different acoustic sources having different frequencies to determine the calibration profile $C(\omega)$ for every frequency of interest. The benefit of an offline calibration technique is that it can provide an accurate calibration profile of a microphone. However, an offline calibration technique can be time consuming and non-economic because each microphone has to be tested for each frequency of interest. Furthermore, an offline calibration technique cannot account for the aging of a microphone and other similar variations of a microphone's characteristics due to time or usage because the calibration is often performed only once prior to an initial use.

Another class of calibration techniques is called an online calibration technique. An online calibration technique can provide a calibration profile of a microphone using signals detected while the microphone is deployed in a real environment. To reduce the dimensionality of the problem, an online calibration technique typically estimates a relative conversion gain factor (instead of the conversion gain factor $A(\omega)$) or a relative phase error (instead of the phase error $\phi(\theta)$). Even with the reduction of dimensionality, most online calibration techniques can only estimate the relative conversion gain factor and not the relative phase error. Also, a small number of online calibration techniques that can estimate both the relative conversion gain factor and the relative phase error make particularly restrictive assumptions about acoustic sources. For example, U.S. Pat. No. 8,243,952, titled "Microphone Array Calibration Method and Apparatus," by Thormundsson, shows a method for estimating the relative phase error between two microphones (or more), by updating the relative phase error only when an acoustic source is perfectly in front of the two microphones. Because it is hard, if not impossible, to estimate when an acoustic source is perfectly in front of the two microphones, the estimated relative phase error can be inaccurate.

The disclosed apparatus, systems, and methods provide a calibration technique for calibrating a set of microphones. Since most applications of multi-microphone systems can accommodate non-ideal microphones, as long as the microphones have substantially identical characteristics, the disclosed calibration technique is configured to calibrate the microphones with respect to a reference microphone. The disclosed technique is particularly well suited to calibrating a set of microphones that are omnidirectional and sufficiently close to one another. The calibration result of an $i^{th}$ microphone with respect to a reference microphone can be represented as a calibration profile in the frequency domain:

$$F_i(\omega)=\lambda_i(\omega)\exp(i\omega_i(\omega)),$$

where $$\lambda_i(\omega) = \frac{A_R(\omega)}{A_i(\omega)},$$

representing a ratio between (1) a conversion gain factor corresponding to the $i^{th}$ microphone $A_i(\omega)$ and a conversion gain factor corresponding to the reference microphone $A_R(\omega)$; and $\phi_i(\omega)=\phi_R(\omega)-\phi_i(\omega)$, representing the relative phase error between the two microphones. $\lambda_i(\omega)$ is also referred to as a magnitude calibration factor of the $i^{th}$ microphone.

The disclosed calibration mechanism can include or use two modules: a magnitude calibration module and a phase calibration module. The magnitude calibration module is configured to determine the magnitude calibration factor $\lambda_i(\omega)$ of a microphone with respect to a reference microphone at each frequency. When microphones are sufficiently close to one another, the acoustic signal received by the microphones would be sufficiently identical. Therefore, any difference in signals detected by the microphones can be attributed to the magnitude calibration factor of the microphones.

Thus, the magnitude calibration module is configured to determine a time-frequency representation (TFR) of the signals detected by the microphones and compute the ratio of their TFRs at the frequency of interest, which would, in theory, be the magnitude calibration factor $\lambda_i(\omega)$ between the microphones at the frequency of interest. However, because of noise and other non-ideal characteristics of microphones, one sample of the TFR ratio may not be sufficiently accurate as an estimate of the magnitude calibration factor $\lambda_i(\omega)$. Therefore, to average out the noise and other non-ideal characteristics, the magnitude calibration module is configured to gather many TFR samples at the frequency of interest, and estimate the magnitude calibration factor from the TFR samples.

In some embodiments, the magnitude calibration module is configured to create a histogram of samples of the TFR ratio at the frequency of interest, and to estimate the magnitude calibration factor from the histogram. As microphones receive additional samples of signals detected by microphones, the magnitude calibration module can use the additional samples to compute additional samples of the TFR ratio, include the additional samples of the TFR ratio to the existing samples of the TFR ratio, and re-estimate the magnitude calibration factor based on the updated set of samples of the TFR ratio. Because the magnitude calibration factor can be re-estimated as additional samples of signals are received, the magnitude calibration module can track time-varying characteristics of microphones due to aging and/or prolonged use.

In some embodiments, the magnitude calibration module is configured to estimate the magnitude calibration factor by determining a relationship between TFR samples corresponding to the same time frame. For example, the magnitude calibration module can assume that the relationship between TFR samples is linear. Therefore, the magnitude calibration module can estimate the magnitude calibration factor by identifying a line that represents the relationship between TFR samples.

In some embodiments, the phase calibration module is configured to determine the relative phase error $\phi_i(\omega)$ of an $i^{th}$ microphone with respect to a reference microphone at each frequency. An observed phase difference between signals detected by two microphones can depend on (1) a direction of arrival of an input acoustic signal and (2) a relative phase error $\phi(\omega)$ of the microphones. Therefore, the phase calibration module is configured to estimate the direction of arrival and the relative phase error from the observed phase difference between signals detected by the two microphones. In some cases, the phase calibration module is configured to estimate the direction of arrival and the relative phase error iteratively one after another. The phase calibration module can further update the estimates of the direction of arrival and the relative phase error as the phase calibration module receives additional samples of the observed phase difference over time. Because the relative phase error can be re-estimated as additional samples of the detected acoustic signals are received, the phase calibration module can also track time-varying characteristics of microphones due to aging and/or prolonged use.

The disclosed calibration technique can be used even when multiple sound sources are present. As described below, the disclosed calibration technique can systematically eliminate any bias introduced by superimposed sources and near-field sources, reducing the number of discarded data samples.

In some embodiments, the disclosed calibration technique can operate as an offline calibration mechanism. For example, a user can test microphones in a silent environment with an integrated microphone in an electronic device, such as a cell phone, and use the magnitude calibration module and the phase calibration module to estimate the calibration profile of the microphones.

In some embodiments, a calibration profile of a microphone can be represented as discrete values. In such a discrete representation of the calibration profile, $\Omega$ can represent a bin in a frequency domain. In some embodiments, the reference microphone can be one of microphones subject to calibration. In some cases, the disclosed calibration technique can be used to select a reference microphone from a set of microphones subject to calibration. In some embodiments, a calibration profile can be represented as the impulse response of the microphone in the time domain.

Figure 2:
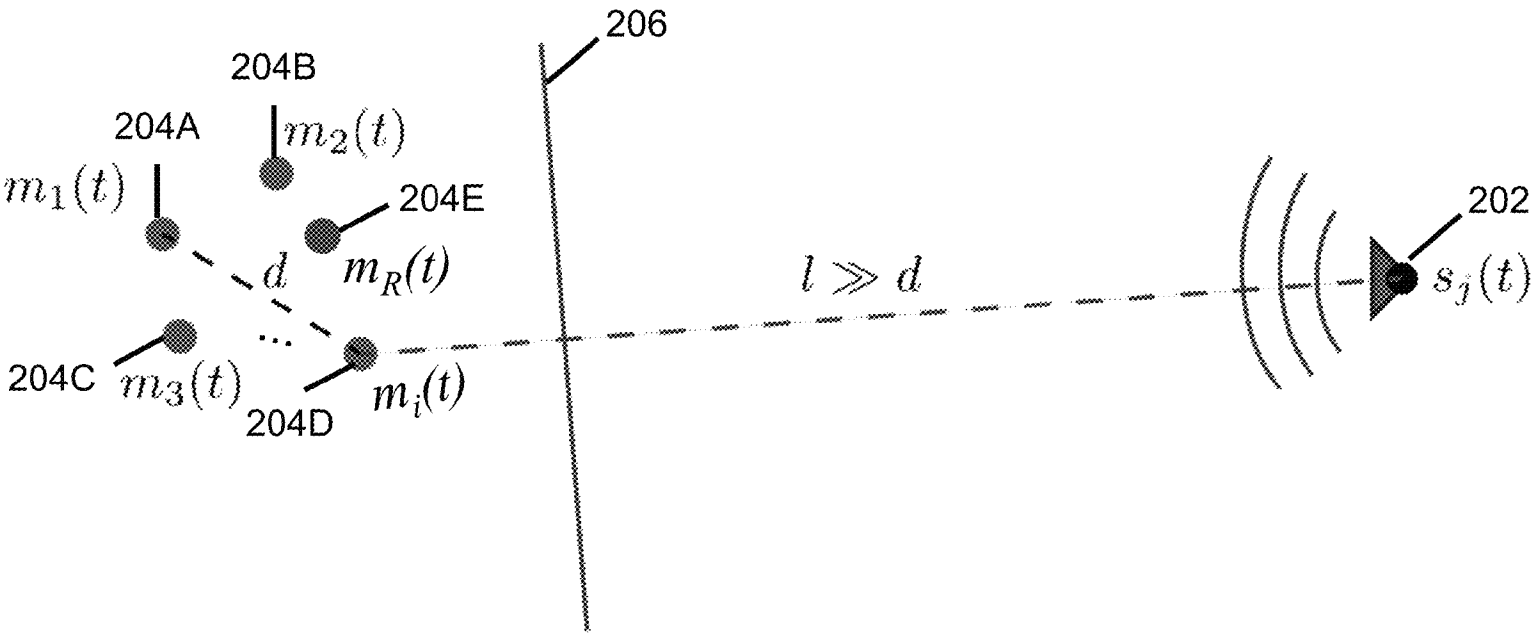
FIG. 2 illustrates a setup in which a calibration apparatus or system can be used in accordance with some embodiments.

FIG. 2 illustrates a scenario in which a disclosed calibration mechanism can be used in accordance with some embodiments. FIG. 2 includes a sound source 202 that generate an acoustic signal s(t). The acoustic signal s(t) can propagate over a transmission medium towards a (i+1) microphones 204A-204E, where i can be any value greater or equal to 1.

If a minimum distance between the microphones and the sound source 202, represented as l, is substantially larger than a maximum distance d between the microphones, then the acoustic signal s(t) can be approximated as a substantially uni-directional plane wave 206. For example, a distance between the microphones can be limited to 2-3 mm, which can be significantly smaller than the wavelength of the input acoustic signal s(t) or the smallest distance between microphones and the acoustic source. As another example, a distance between the microphones can be in the order of centimeters, which is still significantly smaller than the smallest distance between microphones and the acoustic source in many application scenarios (e.g., microphones in a set-top box in a living room receiving human voice instructions).

The microphones 204 can receive the acoustic signal s(t) and convert it into electrical signals. For the purpose of illustration, the electrical signal detected by a reference microphone is referred to as $m_R(t)$; the electrical signal detected by other microphones are referred to as $m_1(t) \ldots m_i(t)$. The microphones 204 can provide the detected signals $m_1(t) \ldots m_i(t)$, $m_R(t)$ to a backend computing device (not shown), and the computing device can determine, based on the detected signals $m_1(t) \ldots m_i(t)$, $m_R(t)$, the calibration profile for i microphones with respect to the reference microphone.

Although FIG. 2 includes only one sound source, the disclosed calibration mechanism can be used in conjunction with any number of sound sources emitting sound contemporaneously. The disclosed technique can also be used in conjunction with any arrangement of microphones. For example, in some embodiments, the microphones can be arranged in an array (e.g., along a straight line); in other embodiments, the microphones can be arranged in a random shape.

Figure 3:
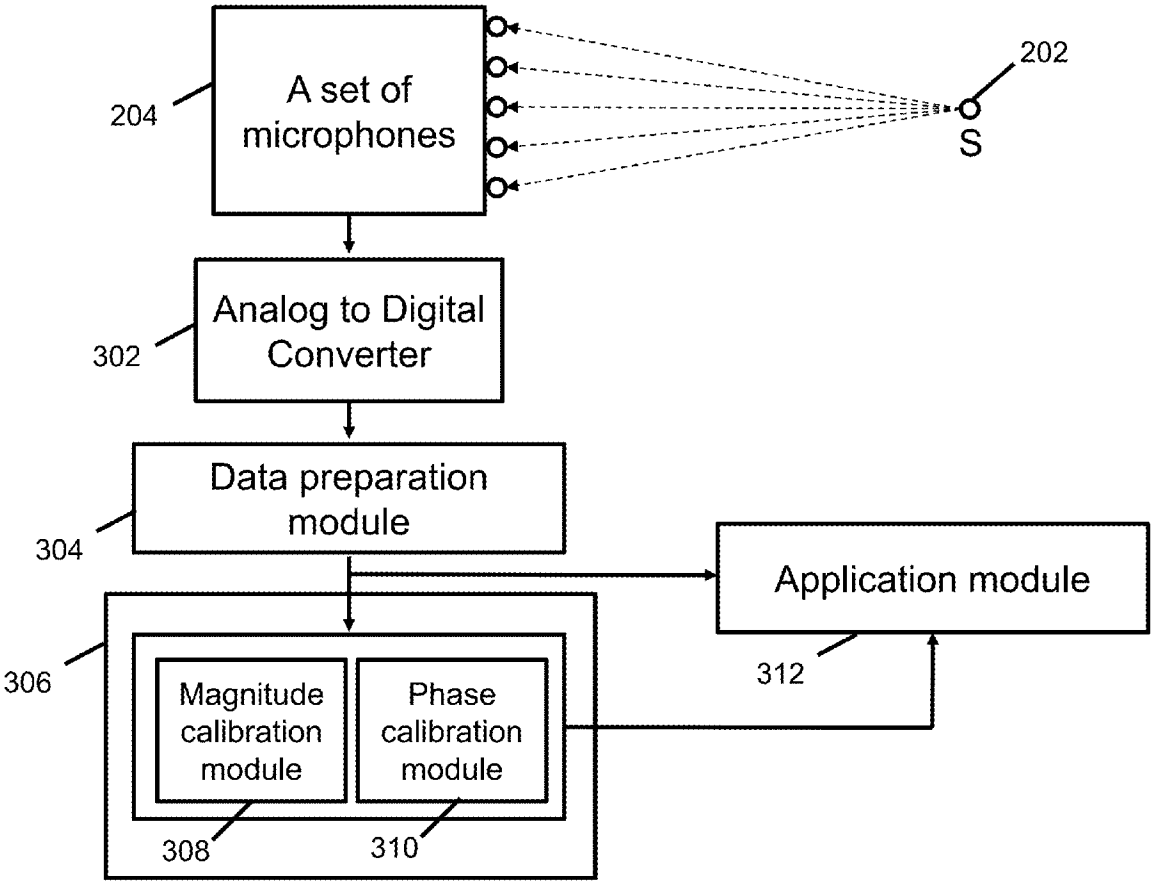
FIG. 3 illustrates how detected signals are further processed to calibrate the microphones in accordance with some embodiments.

FIG. 3 illustrates how the detected signals are further processed by a backend computing device in accordance with some embodiments. FIG. 3 includes a sound source 202, a set of microphones 204, an analog to digital converter (ADC) 302, a data preparation module 304, a calibration module 306, which includes a magnitude calibration module 308 and a phase calibration module 310, and an application module 312. The set of microphones 204 can provide the detected signals $m_1(t) \ldots m_i(t)$, $m_R(t)$, to the ADC 302, and the ADC 302 can provide the digitized signals to the data preparation module 304. The digitized signals are also referred to as $m_1[n] \ldots m_i[n]$, $m_R[n]$, where n can refer to a bin in a time domain (e.g., a range of time or a time frame in which the ADC 302 samples the detected signals.) The digitized signal can also be referred to as a digitized signal stream since the digitized signal can include signal samples corresponding to different time frames.

The data preparation module 304 can compute a time-frequency representation (TFR) of the digitized signals $M_1[n,\Omega] \ldots M_i[n,\Omega]$, $M_R[n,\Omega]$. A TFR of a digitized signal can be associated with a plurality of discrete frequency bins and a plurality of discrete time bins. For example, $[n,\Omega]$ of $M_i[n,\Omega]$ refers to (or indexes) a time-frequency bin in a discretized time-frequency domain. In some embodiments, the size of the plurality of discrete frequency bins can be identical. In other embodiments, the size of the plurality of discrete frequency bins can be different from one another, for example, in a hierarchical time-frequency representation. Likewise, in some embodiments, the size of the plurality of discrete time bins can be identical; in other embodiments, the size of the plurality of discrete time bins can be different from one another. The range of frequencies and the range of time associated with each time-frequency bin can be pre-determined. A TFR of a digitized signal corresponding to a time frame is referred to as a sample or a data sample. The time-frequency representation can include a short-time Fourier transform (STFT), a wavelet transform, a chirplet transform, a fractional Fourier transform, a Newland transform, a Constant Q transform, and a Gabor transform. In some cases, the time-frequency representation can be further generalized to any linear transform that is applied on a windowed portion of the measured signal.

The data preparation module 304 can also compensate for the magnitude calibration factor and the relative phase error between the $i^{th}$ microphone and the reference microphone using the previously estimated calibration profile of the $i^{th}$ microphone, thereby providing the calibrated TFR of the digitized signals $\hat{M}_1[n,\Omega] \ldots \hat{M}_i[n,\Omega]$, $\hat{M}_R[n,\Omega]$.

The data preparation module 304 can subsequently provide the TFR of the digitized converted signals, $M_1[n,\Omega] \ldots M_i[n,\Omega]$, $M_R[n,\Omega]$ to the calibration module 306 and the calibrated TFR of the digitized converted signals, $\hat{M}_1[n,\Omega] \ldots \hat{M}_i[n,\Omega]$, $\hat{M}_R[n,\Omega]$ to the application module 312.

The calibration module 306 can use the magnitude calibration module 308 and the phase calibration module 310 to re-estimate the calibration profile of microphones using the additional TFR samples of the digitized converted signals, $M_1[n,\Omega] \ldots M_i[n,\Omega]$, $M_R[n,\Omega]$ received by the calibration module 306. The calibration module 306 can subsequently provide the re-estimated calibration profile to the data preparation module 304 so that the subsequent TFR of the digitized converted signals can be calibrated using the re-estimated calibration profile. On the other hand, the application module 312 can process the calibrated TFR of digitized signals, received from the data preparation module 304, in various applications. In some embodiments, the calibration module 306 may provide the calibration profile of microphones to the application module 312 so that the application module 312 can process incoming digitized signals using the calibration profile.

Figure 4:
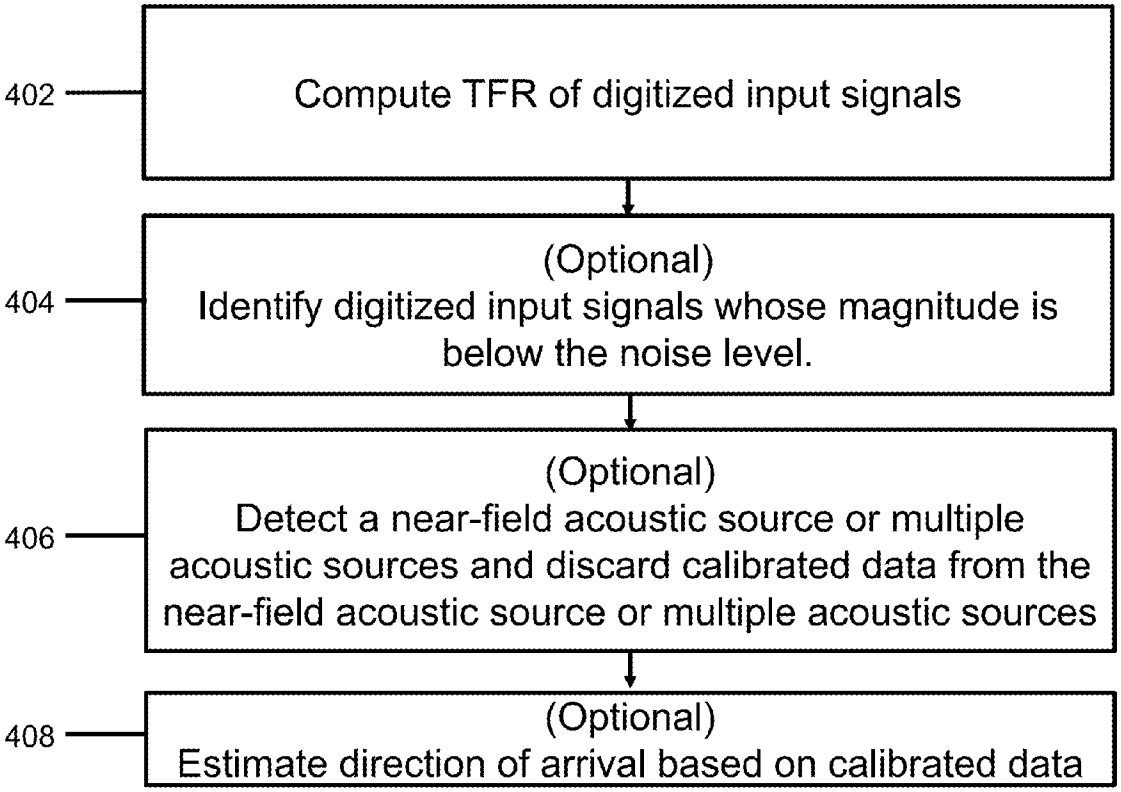
FIG. 4 illustrates a data preparation process of a data preparation module in accordance with some embodiments.

FIG. 4 illustrates a data preparation process of a data preparation module in accordance with some embodiments. In step 402, the data preparation module 304 can receive i+1 digitized signals $m_1[n] \ldots m_i[n]$, $m_R[n]$ from the ADC 304 and compute the TFR of the digitized converted signals, $M_1[n,\Omega] \ldots M_i[n,\Omega]$, $M_R[n,\Omega]$. For example, the data preparation module 304 can compute a discrete short-time Fourier transform (D-STFT) of the i+1 detected signals $m_1[n] \ldots m_i[n]$, $m_R[n]$. The time-frequency resolution of the D-STFT can depend on predetermined time/frequency resolution parameters. The predetermined resolution parameters can depend on an amount of memory available for maintaining calibration profiles and/or the desired resolution of signals for the application module 312. In some embodiments, the data preparation module 304 can receive the i+1 digitized signals $m_1[n] \ldots m_i[n]$, $m_R[n]$ sequentially. In such cases, the data preparation module 304 can compute the TFR of the digitized converted signals, $M_1[n,\Omega] \ldots M_i[n,\Omega]$, $M_R[n,\Omega]$ sequentially as well, similarly as a filter bank. For example, when the data preparation module 304 receives a new digitized signal for a particular time frame for a particular microphone, the data preparation module 304 can compute the TFR for the particular time frame and add a column to the existing TFR corresponding to previous time frames for the particular microphone.

In step 404, the data preparation module 304 can optionally identify data samples having a magnitude that is below a noise level. For example, the data preparation module 304 can receive a noise variance parameter, indicating that a microphone has a noise variance of $\sigma^2$. If a magnitude of the TFR of the target microphone (e.g., a microphone subject to calibrations) at $[n=n_0,\Omega=\Omega_0]$, $M_i[n=n_0,\Omega=\Omega_0]$, is less than $\sigma$, then the data preparation module 304 can identify the particular sample of TFR $M_i[n=n_0,\Omega=\Omega_0]$ as too noisy. If the magnitude of the TFR of the reference microphone, $M_R[n=n_0,\Omega=\Omega_0]$, is less than $\sigma$, then the data preparation module 304 can identify all data samples $M_1[n=n_0,\Omega=\Omega_0], \ldots, M_i[n=n_0,\Omega=\Omega_0]$, $M_R[n=n_0,\Omega=\Omega_0]$ as too noisy, as $M_R[n=n_0,\Omega=\Omega_0]$ can affect the calibration estimates for all microphones. In some embodiments, the data preparation module 304 can represent the identified noisy data samples using a mask. For example, the mask can have the same dimensionality as the TFR of the digitized converted signals, indicating whether or not the data sample corresponding to the bin in the mask has a magnitude less than the noise level.

In step 406, the data preparation module 304 can optionally identify data samples corresponding to an acoustic signal that does not conform to the plane-wave, single-source assumption. The non-conforming acoustic signal can include an acoustic signal received from a near-field acoustic source, an acoustic signal that combines signals from multiple acoustic sources, or an acoustic signal corresponding to a reverberation due to the reverberant source. For example, a near-field acoustic source is an acoustic source that is located physically close to microphones. When an acoustic source is close to the microphones, the incoming acoustic signal is no longer a plane wave. Therefore, the assumption that the received acoustic signal is a plane wave may not hold for a near-field acoustic source.

To determine whether a sample $M_i[n=n_0,\Omega=\Omega_0]$ is associated with a non-conforming acoustic signal, the data preparation module 304 can compute a ratio between the magnitude of the signal at the $i^{th}$ microphone and the reference microphone for the frequency of interest:

$$r_i[n_0, \Omega_0] = \frac{\|M_R[n_0, \Omega_0]\|}{\|M_i[n_0, \Omega_0]\|},$$

and if this ratio $r_i[n_0,\Omega_0]$ is sufficiently different from the current estimate of the magnitude calibration factor $\lambda_i[\Omega]$, then the data preparation module 304 can indicate that the particular data sample $M_i[n_0,\Omega_0]$ is associated with a non-conforming acoustic signal.

In some embodiments, the data preparation module 304 can indicate that a particular data sample is associated with either a near-field acoustic source or multiple acoustic sources when the particular data sample satisfies the following relationship:

$$\|\lambda_i[\Omega_0]-r_i[n_0,\Omega_0]\|<\delta_D$$

where $\delta_D$ is a predetermined threshold. In other embodiments, the data preparation module 304 can indicate that a particular data sample is associated with either a near-field acoustic source or multiple acoustic sources when the particular data sample satisfies the following relationship:

$$\max\left(\frac{\|\lambda_i[\Omega_0]\|}{\|r_i[n_0, \Omega_0]\|}, \frac{\|r_i[n_0, \Omega_0]\|}{\|\lambda_i[\Omega_0]\|}\right) > \delta_R,$$

where $\delta_R$ is a predetermined threshold.

In some embodiments, the data preparation module 304 can identify a data sample associated with a non-conforming acoustic signal using a mask. The mask can have the same dimensionality as the TFR of the digitized converted signals, indicating whether the data sample corresponding to the bin in the mask is associated with either a near-field acoustic source or multiple acoustic sources. The data preparation module 304 can provide the mask to other modules, such as a calibration module 306 or an application module 312, so that the other modules can use the mask to improve a quality of their operations. For example, the application module 312 can use the mask to improve a performance of blind source separation. In some embodiments, the data preparation module

304 can discard data samples associated with either a near-field acoustic source or multiple acoustic sources before providing the data samples to the calibration module 306 or the application module 312.

In some embodiments, the predetermined threshold for detecting data samples from a non-conforming acoustic signal can be adapted based on an environment in which the microphones are deployed. For example, different predetermined thresholds can be used based on whether the microphones are deployed outdoors, indoors, meetings, conference rooms, a living room, a large room, a small room, a rest room, or an automobile. In some cases, the predetermined threshold can be learned using a supervised learning technique, such as regression.

In step 408, the data preparation module 304 can optionally estimate a parameter that is indicative of the direction of arrival (DOA) of the input acoustic signal s(t). The parameter that is indicative of the DOA can be the DOA itself, but can also be any parameter that is correlated with the DOA or is an approximation of the DOA. The parameter that is indicative of the DOA can be referred to as a DOA indicator, or simply as a DOA in the present application. In some cases, the estimated parameter can be used by the application module 312 for its applications. The estimated parameter can also be used by the phase calibration module 310 for estimating the relative phase error for the calibration profile. In some embodiments, the DOA indicator can be estimated by the phase calibration module 310 instead of the data preparation module 304.

In some embodiments, the DOA indicator can be estimated using a multiple signal classification (MUSIC) method. In other embodiments, the DOA indicator can be estimated using an ESPRIT method. In some embodiments, the DOA indicator can be estimated using the beam-forming method.

In some embodiments, the DOA indicator of the input acoustic signal can be estimated by solving a system of linear equations:

$$\begin{bmatrix} \eta_1^T[\Omega,\theta] \\ \cdots \\ \eta_i^T[\Omega,\theta] \end{bmatrix} = 2\pi\frac{\Omega f_s}{2P}v\begin{bmatrix} -r_1- \\ \cdots \\ -r_i- \end{bmatrix}\begin{bmatrix} \cos\theta \\ \sin\theta \end{bmatrix},$$

where $\eta_i^T[\Omega,\theta]$ is a relative phase delay between the $i^{th}$ microphone and the reference microphone (e.g., at a time frame T) due to the DOA indicator $\theta$, $f_s$ is a sampling frequency of the ADC 302, $\Omega$ is a bin in the frequency domain, P indicates the number of frequency bins (e.g., the resolution) for the time-frequency transform such as STFT, $v$ is the speed of the acoustic signal, $r_i$ is a two-dimensional vector representing a location of the $i^{th}$ microphone with respect to the reference microphone, and $\theta$ is the DOA indicator of the acoustic signal. The above system of linear equations relates delays between signals detected by microphones and a DOA indicator of the acoustic signal. The relative phase delay $\eta_i^T[\Omega,\theta]$ can depend on relative positions of the microphones, which can be captured by the two-dimensional vector $r_i$. The rest of the system of linear equations can convert a time delay into a phase delay, based on the frequency and speed of the input acoustic signal. In some embodiments, $f_s$, $\Omega$, and P can be merged into a single term, representing the discrete frequency of an input acoustic signal measured by the microphones.

In some embodiments, the relative phase delay $\eta_i^T[\Omega,\theta]$ can be measured or computed. For example, the phase delay $\eta_i^T[\Omega,\theta]$ can be computed by comparing the TFR values associated with the $i^{th}$ microphone and the reference microphone. In particular, the phase delay $\eta_i^T[\Omega,\theta]$ can be computed as follows:

$$\eta_i^T[\Omega,\theta]=\arg(M_i[n=T,\Omega])-\arg(M_R[n=T,\Omega])$$

where arg provides an angle of a complex variable.

This linear system can be solved with respect to $\theta$ using a linear system solver. Because this equation is an over-complete system (e.g., the system of equations includes more constraints than the number of unknowns) when i>1, the linear system can be solved using a least squares method: finding $\theta$ that reduces an overall least-squares error. In some embodiments, the linear system can be solved using a Moore Penrose pseudoinverse of the matrix $$2\pi\frac{\Omega f_s}{2P}v\begin{bmatrix} -r_1- \\ \cdots \\ -r_i- \end{bmatrix}.$$

Therefore, solving the linear system can involve computing the following:

$$\left(2\pi\frac{\Omega f_s}{2P}v\begin{bmatrix} -r_1- \\ \cdots \\ -r_i- \end{bmatrix}\right)^{\perp}\begin{bmatrix} \eta_1[\Omega,\theta] \\ \cdots \\ \eta_i[\Omega,\theta] \end{bmatrix} = \begin{bmatrix} \cos\theta \\ \sin\theta \end{bmatrix},$$

where $\perp$ indicates a Moore Penrose pseudoinverse.

In some embodiments, the data preparation module 304 can compensate for the magnitude calibration factor and the relative phase error of microphones using previously computed calibration profiles. The data preparation module 304 can compensate for the magnitude/phase error by multiplying the TFR of the digitized converted signal from the $i^{th}$ microphone with the corresponding calibration profiles:

$$\hat{M}_1[n,\Omega]=F_1[\Omega]M_1[n,\Omega]$$

$$\cdots$$

$$\hat{M}_i[n,\Omega]=F_i[\Omega]M_i[n,\Omega]$$

$$\hat{M}_R[n,\Omega]=M_R[n,\Omega]$$

where $F_i[\Omega]$ refers to the $i^{th}$ estimate of the calibration profile for the $i^{th}$ microphone.

Subsequently, the data preparation module 304 can provide, to the calibration module 306 and/or the application module 312, the TFR of the digitized converted signals, $M_1[n,\Omega] \ldots M_i[n,\Omega]$, $M_R[n,\Omega]$, the calibrated TFR of the digitized converted signals, $\hat{M}_1[n,\Omega] \ldots \hat{M}_i[n,\Omega]$, $\hat{M}_R[n,\Omega]$, a first mask identifying noisy data samples, and/or a second mask identifying data samples associated with either a near-field acoustic source or multiple acoustic sources.

The calibration module 306 can use the TFR of the digitized converted signals, $M_1[n,\Omega] \ldots M_i[n,\Omega]$, $M_R[n,\Omega]$ to estimate a calibration profile of microphones in the discrete frequency domain:

$$F_i[\Omega]=\lambda_i[\Omega]\exp(i\phi_i[\Omega]),$$

where $$\lambda_i(\Omega) = \frac{A_R(\Omega)}{A_i(\Omega)},$$

representing a magnitude calibration factor between the $i^{th}$ microphone and the reference microphone, and $\phi_i[\Omega]=\phi_R[\Omega]-\phi_i[\Omega]$, representing a relative phase error between the $i^{th}$ microphone and the reference microphone.

Figure 5:
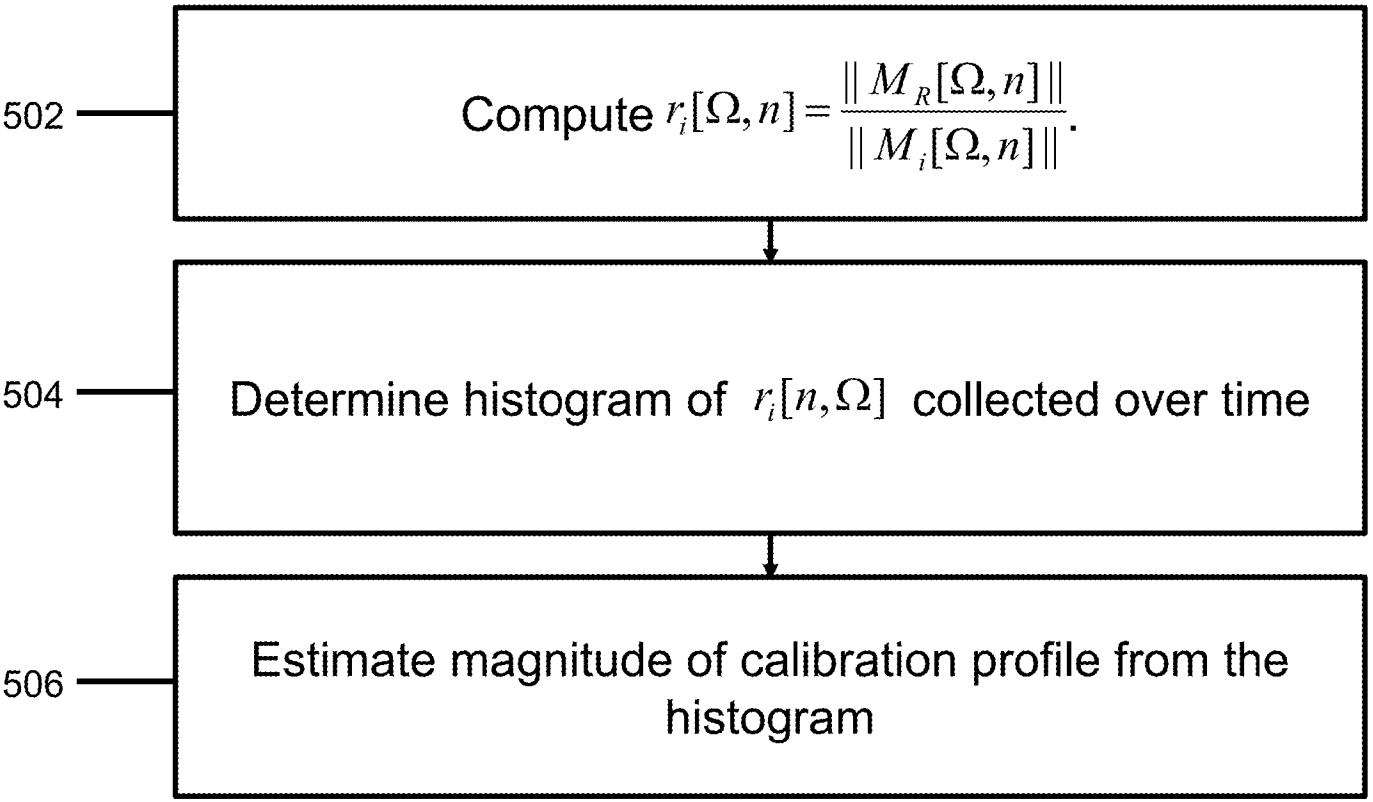
FIG. 5 illustrates a magnitude calibration process of a magnitude calibration module for calibrating a magnitude sensitivity of microphones in accordance with some embodiments.

FIG. 5 illustrates how a magnitude calibration module calibrates a magnitude sensitivity of microphones in accordance with some embodiments. The magnitude calibration module 308 can assume that the microphones are close to each other. The magnitude calibration module 308 can also assume that the likelihood of different acoustic sources occupying the same time-frequency bin in the time-frequency representation is small. This assumption is often satisfied because different sound sources often have different frequency characteristics.

Under these assumptions, if the $i^{th}$ microphone and the reference microphone have an identical magnitude sensitivity, the magnitude of the TFR of the input acoustic signals $M_i[n,\Omega]$ and $M_R[n,\Omega]$ would be identical. Thus, any difference in magnitude between the TFR of the detected signals $M_i[n,\Omega]$ and $M_R[n,\Omega]$ can be attributed to the difference of the magnitude sensitivity at that particular time-frequency bin. The magnitude calibration module 308 can use this characteristic to estimate the magnitude calibration factors.

In step 502, the magnitude calibration module 308 can compute a ratio of magnitudes of the TFR $M_i[n,\Omega]$ and $M_R[n,\Omega]$:

$$r_i[n, \Omega] = \frac{\|M_R[n, \Omega]\|}{\|M_i[n, \Omega]\|}.$$

In some embodiments, the magnitude calibration module 308 can use the mask provided by the data preparation module 304 to remove noisy TFR samples, or TFR samples associated with either a near-field acoustic source or multiple acoustic sources.

In step 504, the magnitude calibration module 308 can collect two or more ratios over time n for a frequency bin $\Omega_0$ to determine summary information of the ratios. The summary information of the ratios can indicate information that is useful for determining the magnitude calibration factor.

In some embodiments, the summary information can include a histogram of the ratios for the $i^{th}$ microphone for the particular frequency bin $\Omega_0$:

$$h_i^T[\Omega_0, r]=\text{hist}(r_i[n,\Omega_0]), n=1 \ldots T$$

where T is the latest time frame for which a ratio sample $r_i[n,\Omega_0]$ is available, and r indicates a ratio magnitude. The histogram is a representation of tabulated frequencies for discrete intervals (bins), where the frequencies indicate a number of ratios that fall into the interval.

Figure 6B:
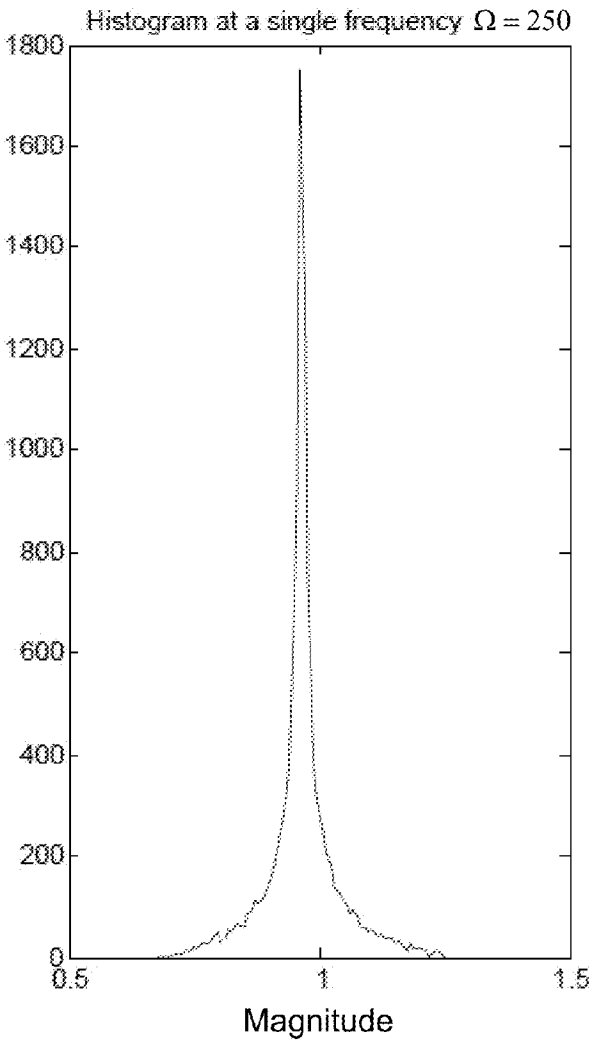
FIGS. 6A-6B illustrate a magnitude ratio histogram $h_i(\omega,r)$ in accordance with some embodiments.
Figure 6A:
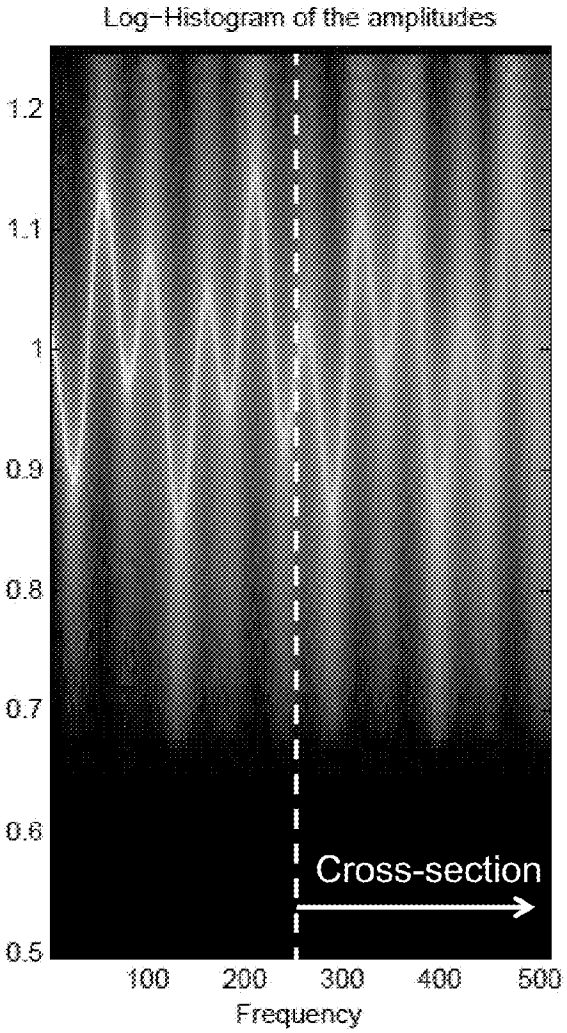

FIGS. 6A-6B illustrate the histogram $h_i^T[\Omega,r]$ in accordance with some embodiments. FIG. 6A shows the histogram $h_i^T[\Omega,r]$ as an image where the row indicates the frequency axis and the column indicate the magnitude axis. The brightness of the histogram $h_i^T[\Omega,r]$ indicates the number of samples in the particular bin $[\Omega,r]$. FIG. 6B shows a cross-section of the image in FIG. 6A at $\Omega=250$: $h_i^T[S\Omega=250,r]$.

In step 506, the magnitude calibration module 308 can use the summary information to estimate the magnitude calibration factor $$\lambda_i[\Omega] = \frac{A_R[\Omega]}{A_i[\Omega]}.$$

In some embodiments, the magnitude calibration module 308 can estimate the magnitude calibration factor by computing a median of ratios of TFRs $M_i[n,\Omega]$ and $M_R[n,\Omega]$:

$$r_i[n, \Omega] = \frac{\|M_R[n, \Omega]\|}{\|M_i[n, \Omega]\|}.$$

In other embodiments, when the summary information includes a histogram of the ratios, the magnitude calibration module 308 can operate an estimator f(•) to the histogram $h_i^T[\Omega,r]$ to estimate the magnitude calibration factor $\lambda_i[\Omega]$:

$$\tilde{\lambda}_{i,T}[\Omega]=f(h_i^T[\Omega,r]),$$

where $\tilde{\lambda}_{i,T}[\Omega]$ indicates an estimate of the magnitude calibration factor $\lambda_i[\Omega]$, and where the subscript T indicates that the magnitude calibration factor $\lambda_i[\Omega]$ is estimated based on samples received up until the time frame T.

In some embodiments, the estimator f(•) can be configured to identify a ratio that has the largest number of samples in the histogram $h_i[\Omega,r]$:

$$\tilde{\lambda}_{i,T}[\Omega] = \underset{r}{\operatorname{argmax}}\, h_i[\Omega, r].$$

In other embodiments, the estimator f(•) can include a regressor that maps the histogram $h_i[\Omega,r]$ to the magnitude calibration factor $\tilde{\lambda}_{i,T}[\Omega]$. The regressor can be trained using a supervised learning technique. For example, a user or a manufacturer can determine a histogram $h_i[\Omega,r]$ and a magnitude calibration factor $\lambda_i[\Omega]$ for a set of microphones manufactured using a similar process. In some instances, the user or the manufacturer can determine the histogram $h_i[\Omega,r]$ and a magnitude calibration factor $\lambda_i[\Omega]$ using an offline calibration technique. Subsequently, the user or the manufacturer can determine either a parametric mapping or a non-parametric mapping between the histogram $h_i[\Omega,r]$ and the magnitude calibration factor $\lambda_i[\Omega]$. This parametric or the non-parametric mapping can be considered the estimator f(•). The parametric mapping can include a linear function or a non-linear function. The non-parametric function can include a support vector machine, a kernel machine, or a nearest neighbor matching machine.

In some embodiments, the magnitude calibration module 308 can determine the magnitude calibration factor $\tilde{\lambda}_{i,T}[\Omega]$ using a maximum likelihood (ML) estimator. The ML estimator can estimate $\tilde{\lambda}_{i,T}[\Omega]$ by identifying the value of r that maximizes the histogram $h_i[\Omega,r]$:

$$\tilde{\lambda}_{i,T}[\Omega] = \underset{\lambda_i[\Omega]}{\operatorname{argmax}} \prod_t p(r_i[n, \Omega] \mid \lambda_i[\Omega]).$$

The magnitude calibration module 308 can model the likelihood term as follows:

$$p(r_i[n,\Omega]|\lambda_i[\Omega]) \propto \exp(-(r_i[n,\Omega]-\lambda_i[\Omega])^2).$$

In some embodiments, the magnitude calibration module 308 can determine the magnitude calibration factor $\tilde{\lambda}_{i,T}[\Omega]$ using a maximum aposteriori (MAP) estimator. For example, the estimator can identify, for each frequency, the magnitude calibration factor $\tilde{\lambda}_{i,T}[\Omega]$ that maximizes the following:

$$\tilde{\lambda}_{i,T}[\Omega] = \underset{\lambda_i[\Omega]}{\operatorname{argmax}} \prod_t p(r_i[n, \Omega] \mid \lambda_i[\Omega]) p(\lambda_i[\Omega]).$$

As discussed above, the magnitude calibration module 308 can model the likelihood term as follows:

$$p(r_i[n,\Omega]/\lambda_i[\Omega]) \propto \exp(-(r_i[n,\Omega]-\lambda_i[\Omega])^2).$$

In some embodiments, the magnitude calibration module 308 can model the prior term as a smoothing prior, which favors a small difference between estimated magnitude calibration factors in adjacent frequencies. This way, the MAP estimator can identify the magnitude calibration factor $\lambda_i[\Omega]$ that maximizes the likelihood while preserving the smoothness of the magnitude calibration factor $\lambda_i[\Omega]$ in the frequency domain. In some sense, the smoothing prior can low-pass filter the estimated magnitude calibration factors in adjacent frequencies. One possible smoothing prior can be based on a Gaussian distribution, as provided below:

$$p(\lambda_i[\Omega]) \propto \exp(-\alpha(\lambda_i[\Omega]-\lambda_i[\Omega+\Delta\Omega])^2), \alpha>0$$

where $\Omega+\Delta\Omega$ indicates a frequency bin adjacent to $\Omega$. Another possible smoothing prior can be based on other types of distributions, such as a Laplacian distribution, a generalized Gaussian distribution, and a generalized Laplacian distribution.

In some embodiments, the value of $\tilde{\lambda}_{i,T}[\Omega]$ can be determined by solving a convex minimization function:

$$\tilde{\lambda}_{i,T}[\Omega] = \underset{\lambda[\Omega]}{\operatorname{argmin}} \left\{ \{\lambda[\Omega] - h_{i,\Omega}^{T}(r)\}^2 + \alpha \|D(\lambda[\Omega])\|^{\kappa} \right\}$$

where D is a derivative operator in a frequency domain, and a is the smoothing strength. The derivative operator can be one of a first order derivative operator, a second order derivative operator, or a higher-order derivative operator. Empirically, an L1 regularization (i.e., $\kappa=1$) works well. The technique is also known as Total variation.

In some embodiments, the magnitude calibration module 308 can model the prior term using statistics about microphones. For example, a vendor can provide statistics on a distribution of the magnitude calibration factor $\lambda[\Omega]$ for microphones sold by the vendor. The prior term can take into account such additional statistics about the microphones to estimate the magnitude calibration factor $\tilde{\lambda}_{i,T}[\Omega]$.

As the magnitude calibration module 308 receives additional TFR samples from the data preparation module 304, the magnitude calibration module 308 can compute the ratio $r_i[n,\Omega]$ based on the additional samples and use the newly-computed ratios to re-estimate the magnitude calibration factor $\tilde{\lambda}_{i,T}[\Omega]$. For example, the magnitude calibration module 308 can add the additional ratio $r_i[\Omega,n]$, from a time frame T+1, to the histogram, $h_{i,\Omega}^{T+1}(r)=\text{hist}(r_i[n,\Omega]), n=1 \ldots (T+1)$, and re-estimate the magnitude calibration factor $\tilde{\lambda}_{i,T+1}[\Omega]$ based on the updated histogram. This way, as microphones detect additional acoustic signals over time, the magnitude calibration module 308 can re-estimate the magnitude calibration factor $\lambda_i[\Omega]$ to track any changes in the magnitude calibration factor $\lambda_i[\Omega]$.

In some embodiments, the magnitude calibration module 308 can determine the magnitude calibration factor by estimating a relationship between TFR samples of the input acoustic signals $M_i[n,\Omega]$ and $M_R[n,\Omega]$ received over a plurality of time frames.

Figure 14:
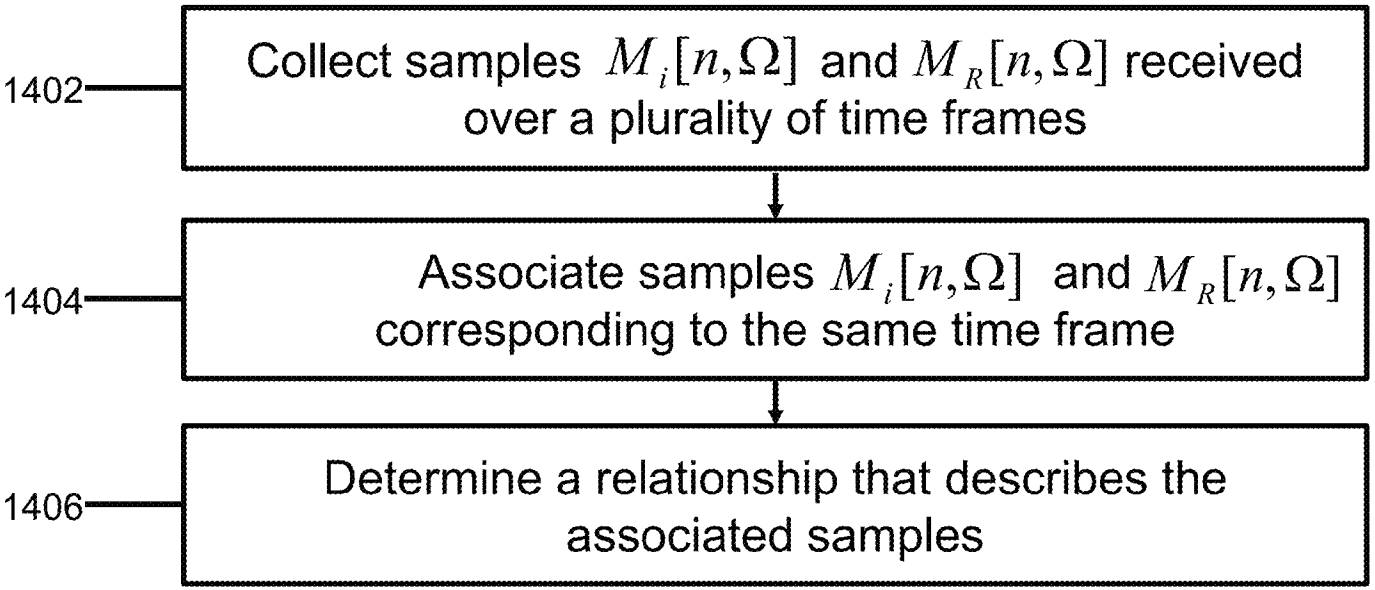
FIG. 14 illustrates a process for determining a magnitude calibration factor by estimating a relationship between time-frequency representations of input acoustic signals received over multiple time frames in accordance with some embodiments.

FIG. 14 illustrates a process for determining the magnitude calibration factor by estimating a relationship between TFR samples of the input acoustic signals received over multiple time frames in accordance with some embodiments.

In step 1402, the magnitude calibration module 308 can collect TFR samples of the input acoustic signals $M_i[n,\Omega]$ and $M_R[n,\Omega]$ over a plurality of time frames.

Figure 15:
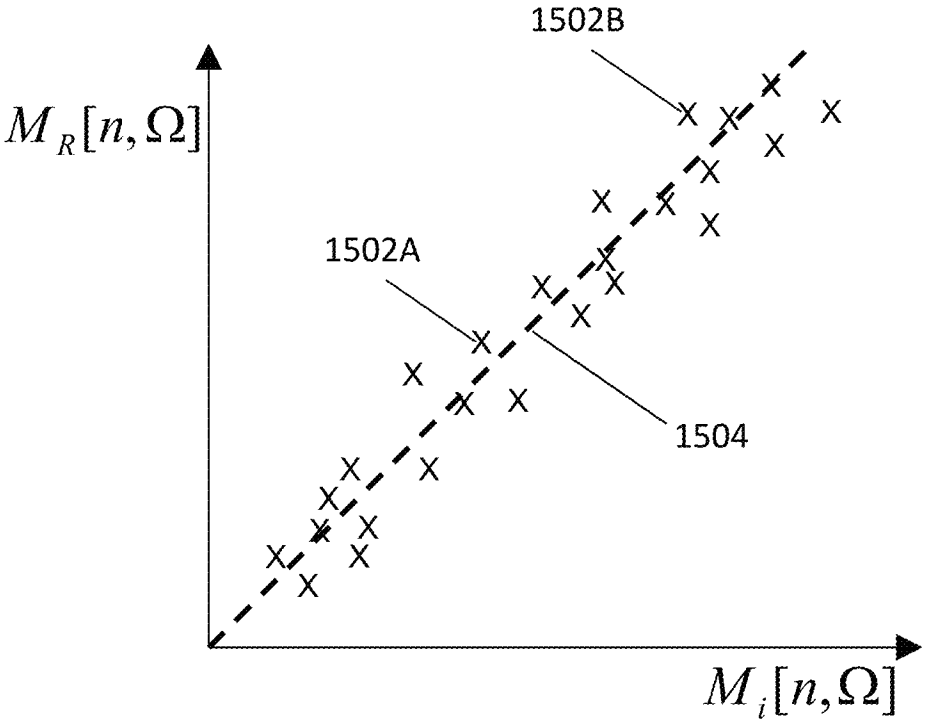
FIG. 15 illustrates an exemplary scatter plot that relates time-frequency representation samples corresponding to the same time frame in accordance with some embodiments.

In step 1404, the magnitude calibration module 308 can associate the TFR samples $M_i[n,\Omega]$ and $M_R[n,\Omega]$ corresponding to the same time frame. FIG. 15 illustrates an exemplary scatter plot that relates TFR samples $M_i[n,\Omega]$ and $M_R[n,\Omega]$ corresponding to the same time frame in accordance with some embodiments. Each scatter point 1502 on the scatter plot corresponds to a value of TFR samples $M_i[n,\Omega]$ and $M_R[n,\Omega]$ for the same time frame.

In step 1406, the magnitude calibration module 308 can determine a relationship between TFR samples $M_i[n,\Omega]$ and $M_R[n,\Omega]$ corresponding to the same time frame.

In some embodiments, the magnitude calibration module 308 can assume that the TFR samples of the input acoustic signals $M_i[n,\Omega]$ and $M_R[n,\Omega]$ have a linear relationship. Therefore, the magnitude calibration module 308 can be configured to determine a line that describes the linear relationship between TFR samples of the input acoustic signals $M_i[n,\Omega]$ and $M_R[n,\Omega]$.

In some embodiments, the magnitude calibration module 308 can further assume that the line that represents the linear relationship between the TFR samples $M_i[n,\Omega]$ and $M_R[n,\Omega]$ goes through the origin of the scatter plot. For example, for the TFR samples $M_i[n,\Omega]$ and $M_R[n,\Omega]$ illustrated in FIG. 15, the magnitude calibration module 308 can identify the line 1504 that describes the linear relationship (with zero offset) between the TFR samples $M_i[n,\Omega]$ and $M_R[n,\Omega]$. In some embodiments, the magnitude calibration module 308 can determine the line using a line-fitting technique. The line fitting technique can be designed to identify a line that minimizes the aggregate orthogonal distances between the scatter points and the line. For example, the line fitting technique can be designed to identify a line that minimizes the sum of squared orthogonal distances between the scatter points and the line. As another example, the line fitting technique can be designed to identify a line that minimizes the sum of norms of orthogonal distances between the scatter points and the line.

In some embodiments, the magnitude calibration module 308 can assume that the TFR samples of the input acoustic signals $M_i[n,\Omega]$ and $M_R[n,\Omega]$ have a relationship that can be described using an arbitrary spline curve. In such embodiments, the magnitude calibration module 308 can identify the spline curve using a spline curve-fitting technique.

A phase calibration module 310 can be configured to identify a relative phase error $\phi_i[\Omega]$ between the $i^{th}$ microphone and the reference microphone. The observed phase delay of a signal, observed at two different microphones, can depend on both the direction of arrival $\theta$ of a plane wave and a phase error $\theta_i[\Omega]$ imparted by the microphone's characteristics.

Figure 7:
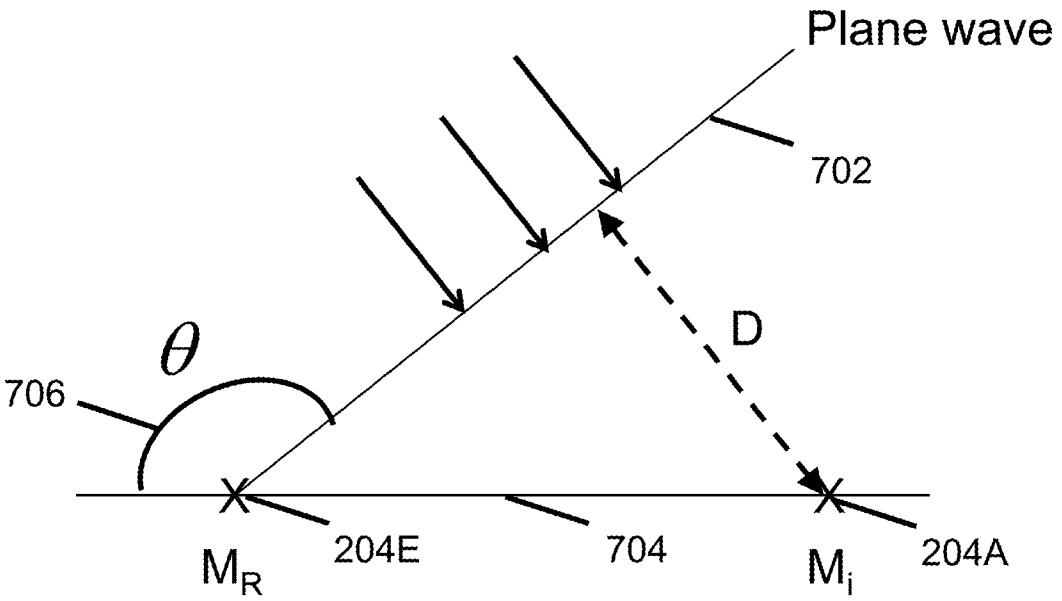
FIG. 7 illustrates how the direction of arrival $\theta$ and the phase error $\phi_i(\omega)$ of the microphone causes a phase difference between observed signals.

FIG. 7 illustrates how the direction of arrival $\theta$ and the phase error $\phi_i[\Omega]$ of the microphone causes a phase difference between detected signals. FIG. 7 includes two microphones, $M_R$ 204E and $M_i$ 204A, and each microphone receives the same acoustic signal 702. If the acoustic source is far away from the two microphones, then the acoustic signal can be approximated as a plane wave 702. The plane wave can be incident on a line 704 connecting the microphones 204 at an angle θ 706, referred to as a direction of arrival (DOA). If the DOA θ 706 is an integer multiple of π, then the plane wave would arrive at the microphones at the same time. In this case, the phase difference between the signal detected by the reference microphone and the signal detected by the $i^{th}$ microphone would be a function of the relative phase error $\phi_i[\Omega]$ between the reference microphone and the $i^{th}$ microphone.

However, if the DOA θ is not an integer multiple of π, as shown in FIG. 7, then the phase difference between the signal observed at the reference microphone and the signal observed at the $i^{th}$ microphone would be a function of both the relative phase error $\phi_i[\Omega]$ and the DOA θ. In FIG. 7, the plane wave is arriving at an angle θ in which the plane wave hits the reference microphone $M_R$ before it hits the $i^{th}$ microphone $M_i$. In this illustration, the plane wave has to travel an additional distance D to reach the $i^{th}$ microphone $M_i$. This additional distance, which is a function of the DOA θ, causes an additional phase difference between the signal observed at the reference microphone $M_R$ and the signal observed at the $i^{th}$ microphone. Therefore, if the DOA θ is not an integer multiple of π, then the phase difference between the signal observed at the reference microphone and the signal observed at the $i^{th}$ microphone would be a function of both the relative phase error $\phi_i[\Omega]$ and the DOA θ. The phase delay between signals detected from a reference microphone and an $i^{th}$ microphone due to the DOA θ can be represented as $\eta_i[\Omega,\theta]$.

The phase delay $\eta_i[\Omega,\theta]$, the relative phase error $\phi_i[\Omega]$, and the DOA θ can be related by the following system of linear equations:

$$\begin{bmatrix} \eta_1[\Omega,\theta]+\varphi_1[\Omega] \\ \cdots \\ \eta_i[\Omega,\theta]+\varphi_i[\Omega] \end{bmatrix} = 2\pi\frac{\Omega f_s}{2P}v\begin{bmatrix} -r_1- \\ \cdots \\ -r_i- \end{bmatrix}\begin{bmatrix} \cos\theta \\ \sin\theta \end{bmatrix},$$

where $\eta_i[\Omega,\theta]$ is a phase delay, $\phi_i$ is a relative phase error, $f_s$ is a sampling frequency, Ω is a frequency bin, P indicates the number of frequency bins (e.g., the resolution) of the STFT, v is the speed of the acoustic signal, $r_i$ is a two-dimensional vector representing the location of the $i^{th}$ microphone with respect to the reference microphone, and θ is the DOA of the acoustic signal. The phase calibration module 308 is configured to measure the phase delay $\eta_i[\Omega,\theta]$ due to the DOA θ, and solve the above equations with respect to both the DOA θ and the relative phase error $\phi_i[\Omega]$ to determine the relative phase error $\phi_i[\Omega]$.

In some embodiments, the system of linear equations can be solved in two steps: the first step for estimating the DOA θ and the second step for determining the relative phase error $\phi_i[\Omega]$. In some cases, the DOA θ can be estimated using a multiple signal classification (MUSIC) method. In other cases, the DOA θ can be estimated using an ESPRIT method. In yet other cases, the DOA θ can be estimated using the beam-forming method.

Figure 8A:
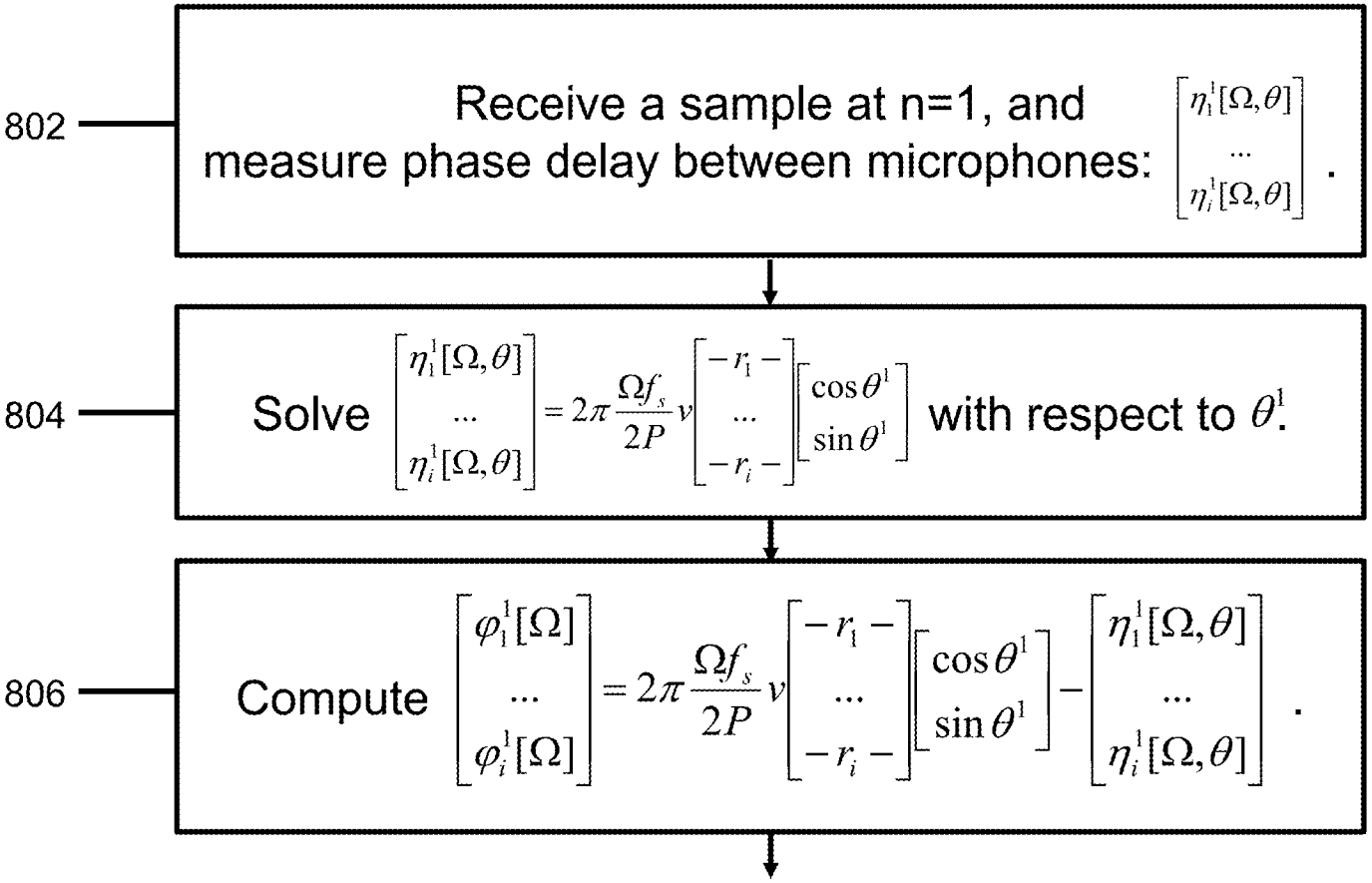
FIGS. 8A-8B illustrate a process for solving a system of linear equations in accordance with some embodiments.
Figure 8B:
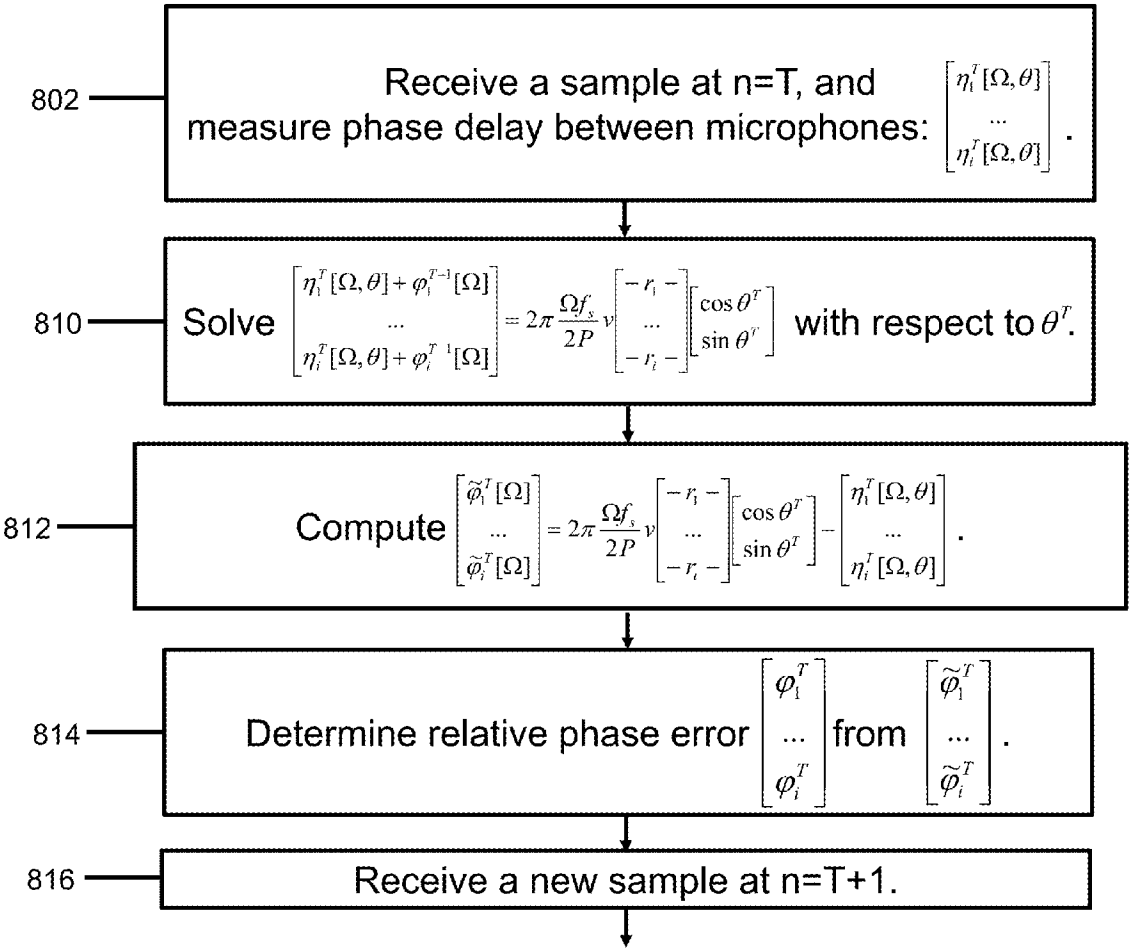

In some embodiments, the DOA θ and the relative phase error $\phi[\Omega]$ can be estimated by directly solving the above system of linear equations. FIGS. 8A-8B illustrate a process for solving the system of linear equations in accordance with some embodiments. The phase calibration module 310 can use this process to estimate the relative phase error $\phi[\Omega]$. Suppose that the phase calibration module 310 has not received any TFR of an acoustic signal prior to n=1. Because the phase calibration module 310 does not have any information about the relative phase error $\phi[\Omega]$ or the DOA θ, the phase calibration module can initialize the relative phase error $\phi_i[\Omega]$ to zero for all microphones (e.g., the microphones have identical phase characteristics.)

In step 802, the phase calibration module 310 can receive a TFR of an acoustic signal received by the $i^{th}$ microphone and the reference microphone. From the received TFR sample, the phase calibration module 310 can measure a phase delay $\eta_i^1[\Omega,\theta]$ between the $i^{th}$ microphone and the reference microphone, where the superscript "1" indicates that the phase delay is associated with the $1^{st}$ TFR sample. The phase delay $\eta_i^1[\Omega,\theta]$ can be computed by comparing the TFR values associated with the $i^{th}$ microphone and the reference microphone. In particular, the phase delay $\eta_i^1[\Omega,\theta]$ can be computed as follows:

$$\eta_i^1[\varphi,\theta]=\arg(M_i[n=1,\omega])-\arg(M_R[n=1,\Omega])$$

where arg provides an angle of a complex variable.

In step 804, the phase calibration module 310 can solve the system of linear equations with respect to the DOA θ using the measured phase delay $\eta_i^1[\Omega,\theta]$, assuming that the relative phase error $\phi_i[\Omega]$ is zero:

$$\begin{bmatrix} \eta_1^1[\Omega,\theta] \\ \cdots \\ \eta_i^1[\Omega,\theta] \end{bmatrix} = 2\pi\frac{\Omega f_s}{2P}v\begin{bmatrix} -r_1- \\ \cdots \\ -r_i- \end{bmatrix}\begin{bmatrix} \cos\theta^1 \\ \sin\theta^1 \end{bmatrix},$$

where $\theta^1$ indicates the estimate of the DOA at t=1, and i>1. When the number of microphones in addition to the reference microphone is 2 (i.e., i=2), then the above system of equations can be solved by inverting $$2\pi\frac{\Omega f_s}{2P}v\begin{bmatrix} -r_1- \\ \cdots \\ -r_i- \end{bmatrix}.$$

When the number of microphones in addition to the reference microphone is greater than 2 (i.e., i>2), then the system is over-complete and can be solved using a variety of linear solver. For example, the phase calibration module 310 can solve the above system using a least-squares technique:

$$\theta^1 = \underset{\theta}{\operatorname{argmin}}\left\{\left\|\begin{bmatrix} \eta_1^1[\Omega,\theta] \\ \cdots \\ \eta_i^1[\Omega,\theta] \end{bmatrix} - 2\pi\frac{\Omega f_s}{2P}v\begin{bmatrix} -r_1- \\ \cdots \\ -r_i- \end{bmatrix}\begin{bmatrix} \cos\theta \\ \sin\theta \end{bmatrix}\right\|^2\right\}$$

In step 806, the phase calibration module 310 solve the following equation with respect to $$\begin{bmatrix} \varphi_1^1[\Omega] \\ \cdots \\ \varphi_i^1[\Omega] \end{bmatrix},$$

using the value of $\theta^1$ estimated in step 804 and the measured phase delay $$\begin{bmatrix} \eta_1^1[\Omega,\theta] \\ \cdots \\ \eta_i^1[\Omega,\theta] \end{bmatrix},$$

to estimate the relative phase error $$\begin{bmatrix}\varphi_1^1[\Omega]\\ \cdots\\ \varphi_i^1[\Omega]\end{bmatrix}:\begin{bmatrix}\varphi_1^1[\Omega]\\ \cdots\\ \varphi_i^1[\Omega]\end{bmatrix}=2\pi\frac{\Omega f_s}{2P}v\begin{bmatrix}-r_1-\\ \cdots\\ -r_i-\end{bmatrix}\begin{bmatrix}\cos\theta^1\\ \sin\theta^1\end{bmatrix}-\begin{bmatrix}\eta_1^1[\Omega,\theta]\\ \cdots\\ \eta_i^1[\Omega,\theta]\end{bmatrix}.$$

Steps 808-814 show how the phase calibration module 310 re-estimates the relative phase errors when it receives a new data sample at n=T. In step 808, the phase calibration module 310 receives a new signal sample at n=T, and the phase calibration module 310 can measure a phase delay $\eta_i^T[\Omega,\theta]$ between the $i^{th}$ microphone and the reference microphone. In step 810, the phase calibration module 310 can estimate the DOA $\theta^T$ by solving the following system with respect to $\theta^T$:

$$\begin{bmatrix}\eta_1^T[\Omega,\theta]+\varphi_1^{T-1}[\Omega]\\ \cdots\\ \eta_i^T[\Omega,\theta]+\varphi_i^{T-1}[\Omega]\end{bmatrix}=2\pi\frac{\Omega f_s}{2P}v\begin{bmatrix}-r_1-\\ \cdots\\ -r_i-\end{bmatrix}\begin{bmatrix}\cos\theta^T\\ \sin\theta^T\end{bmatrix}$$

where $\begin{bmatrix}\varphi_1^{T-1}[\Omega]\\ \cdots\\ \varphi_i^{T-1}[\Omega]\end{bmatrix}$ indicates the relative phase error estimated using data samples received up to the time frame n=T−1. In step 812, once the DOA $\theta^T$ of the $T^{th}$ sample is estimated, the phase calibration module 310 can estimate a temporary relative phase error $$\begin{bmatrix}\tilde{\varphi}_1^T[\Omega]\\ \cdots\\ \tilde{\varphi}_i^T[\Omega]\end{bmatrix}$$

by solving the following system with respect to $$\begin{bmatrix}\tilde{\varphi}_1^T[\Omega]\\ \cdots\\ \tilde{\varphi}_i^T[\Omega]\end{bmatrix}:\begin{bmatrix}\tilde{\varphi}_1^T[\Omega]\\ \cdots\\ \tilde{\varphi}_i^T[\Omega]\end{bmatrix}=2\pi\frac{\Omega f_s}{2P}v\begin{bmatrix}-r_1-\\ \cdots\\ -r_i-\end{bmatrix}\begin{bmatrix}\cos\theta^T\\ \sin\theta^T\end{bmatrix}-\begin{bmatrix}\eta_1^T[\Omega,\theta]\\ \cdots\\ \eta_i^T[\Omega,\theta]\end{bmatrix}.$$

In some embodiments, the phase calibration module 310 can regularize the temporary relative phase error $$\begin{bmatrix}\tilde{\varphi}_1^T[\Omega]\\ \cdots\\ \tilde{\varphi}_i^T[\Omega]\end{bmatrix}$$

such that adjacent frequencies have similar relative phase errors. For example, the phase calibration module 310 can solve the above linear system by minimizing the following energy function with respect to $$\begin{bmatrix}\tilde{\varphi}_1^T[\Omega]\\ \cdots\\ \tilde{\varphi}_i^T[\Omega]\end{bmatrix}:\begin{bmatrix}\tilde{\varphi}_1^T[\Omega]\\ \cdots\\ \tilde{\varphi}_i^T[\Omega]\end{bmatrix}=$$

-continued $$\underset{\begin{bmatrix}\tilde{\varphi}_1^T[\Omega]\\ \cdots\\ \tilde{\varphi}_i^T[\Omega]\end{bmatrix}}{\operatorname{argmin}}\left\{\left\|\begin{bmatrix}\tilde{\varphi}_1^T[\Omega]\\ \cdots\\ \tilde{\varphi}_i^T[\Omega]\end{bmatrix}-\left\{2\pi\frac{\Omega f_s}{2P}v\begin{bmatrix}-r_1-\\ \cdots\\ -r_i-\end{bmatrix}\begin{bmatrix}\cos\theta^T\\ \sin\theta^T\end{bmatrix}-\begin{bmatrix}\eta_1^T[\Omega,\theta]\\ \cdots\\ \eta_i^T[\Omega,\theta]\end{bmatrix}\right\}\right\|^2+\alpha\left\|D\left(\begin{bmatrix}\tilde{\varphi}_1^T[\Omega]\\ \cdots\\ \tilde{\varphi}_i^T[\Omega]\end{bmatrix}\right)\right\|^\kappa\right\}$$

where D is a derivative operator in a frequency domain, and α and κ are parameters for controlling the amount of regularization. The derivative operator can be one of a first order derivative operator, a second order derivative operator, or a higher-order derivative operator. Empirically, an L1 regularization (i.e., κ=1) works well.

In step 814, the phase calibration block 310 can estimate the relative phase error at the time frame T, $$\begin{bmatrix}\varphi_1^T[\Omega]\\ \cdots\\ \varphi_i^T[\Omega]\end{bmatrix},$$

based on the temporary relative phase error $$\begin{bmatrix}\tilde{\varphi}_1^T[\Omega]\\ \cdots\\ \tilde{\varphi}_i^T[\Omega]\end{bmatrix}.$$

In some embodiments, the phase calibration block 310 can set the temporary relative phase error $$\begin{bmatrix}\tilde{\varphi}_1^T[\Omega]\\ \cdots\\ \tilde{\varphi}_i^T[\Omega]\end{bmatrix}$$

as the relative phase error at time frame T:

$$\begin{bmatrix}\varphi_1^T[\Omega]\\ \cdots\\ \varphi_i^T[\Omega]\end{bmatrix}=\begin{bmatrix}\tilde{\varphi}_1^T[\Omega]\\ \cdots\\ \tilde{\varphi}_i^T[\Omega]\end{bmatrix}.$$

In other embodiments, the phase calibration block 310 can update the relative phase error estimated at the time frame T−1, $$\begin{bmatrix}\varphi_1^{T-1}[\Omega]\\ \cdots\\ \varphi_i^{T-1}[\Omega]\end{bmatrix},$$

using the temporary relative phase error $$\begin{bmatrix}\varphi_1^{T-1}[\Omega]\\ \cdots\\ \varphi_i^{T-1}[\Omega]\end{bmatrix}$$

so that the relative phase error does not change drastically across adjacent time frames. For example, the phase calibra tion block 310 can compute the relative phase error estimated at the time frame T as follows:

$$\begin{bmatrix} \varphi_i^T[\Omega_0] \\ \cdots \\ \varphi_i^T[\Omega_p] \end{bmatrix} = S \begin{bmatrix} \varphi_i^{T-1}[\Omega_0] \\ \cdots \\ \varphi_i^{T-1}[\Omega_p] \end{bmatrix} + \mu \left( \begin{bmatrix} \tilde{\varphi}_i^T[\Omega_0] \\ \cdots \\ \tilde{\varphi}_i^T[\Omega_p] \end{bmatrix} - \begin{bmatrix} \varphi_i^{T-1}[\Omega_0] \\ \cdots \\ \varphi_i^{T-1}[\Omega_p] \end{bmatrix} \right)$$

where $\phi_i^T[\Omega_p]$ is a relative phase error estimated at the time frame T for the frequency of $\Omega_p$; μ indicates a learning step size for updating the relative phase error estimated at the time frame T−1; and S indicates a P-by-P transmission matrix. μ can be used to control the rate at which the relative phase error at the time frame T−1 is updated based on the temporary relative phase error $$\begin{bmatrix} \tilde{\varphi}_i^T[\Omega_0] \\ \cdots \\ \tilde{\varphi}_i^T[\Omega_p] \end{bmatrix}.$$

In some cases, the transmission matrix S can be an identity matrix. In other cases, the transmission matrix can be a smoothing operator that smooth adjacent frequency bins of the relative phase error estimated at the time frame T−1. For example, the transmission matrix can be:

$$S = \beta \begin{bmatrix} 1 & 1 & 0 & \dots & 0 & 0 \\ 0 & 1 & 1 & \dots & 0 & 0 \\ 0 & 0 & 1 & \dots & 0 & 0 \\ 0 & 0 & 0 & \dots & 0 & 0 \\ \dots & \dots & \dots & \dots & \dots & \dots \\ 0 & 0 & 0 & \dots & 1 & 1 \end{bmatrix} + (1-\beta)I$$

where I is an identity matrix, and β controls an extent to which the previous estimates of the relative phase error are smoothed over frequency.

The steps 808-814 can be repeated for additional samples received over time, as indicated in step 816. Therefore, the phase calibration module 310 can track any changes of relative phase error over a period of time.

In some embodiments, the phase calibration module 310 can use other types of optimization techniques to jointly estimate the temporary relative phase error $\phi_i[\Omega]$ and the DOA θ satisfying the following system of linear equations:

$$\begin{bmatrix} \tilde{\varphi}_1^T[\Omega] \\ \cdots \\ \tilde{\varphi}_i^T[\Omega] \end{bmatrix} + \begin{bmatrix} \eta_1^T[\Omega, \theta] \\ \cdots \\ \eta_i^T[\Omega, \theta] \end{bmatrix} = 2\pi \frac{\Omega f_s}{2P} v \begin{bmatrix} -r_1 - \\ \cdots \\ -r_i - \end{bmatrix} \begin{bmatrix} \cos\theta^T \\ \sin\theta^T \end{bmatrix}.$$

In some embodiments, the phase calibration module 310 can use a gradient descent optimization technique to solve the following function with respect to the temporary relative phase error $\phi_i[\Omega]$ and the DOA θ jointly:

$$\begin{bmatrix} \tilde{\varphi}_1^T[\Omega] \\ \cdots \\ \tilde{\varphi}_i^T[\Omega] \end{bmatrix} =$$

-continued $$\underset{\begin{bmatrix} \tilde{\varphi}_1^T[\Omega] \\ \cdots \\ \tilde{\varphi}_i^T[\Omega] \end{bmatrix}, \theta^T}{\operatorname{argmin}} \left\{ \left\| \begin{bmatrix} \tilde{\varphi}_1^T[\Omega] \\ \cdots \\ \tilde{\varphi}_i^T[\Omega] \end{bmatrix} - \left\{ 2\pi \frac{\Omega f_s}{2P} v \begin{bmatrix} -r_1 - \\ \cdots \\ -r_i - \end{bmatrix} \begin{bmatrix} \cos\theta^T \\ \sin\theta^T \end{bmatrix} - \begin{bmatrix} \eta_1^T[\Omega, \theta] \\ \cdots \\ \eta_i^T[\Omega, \theta] \end{bmatrix} \right\} \right\|^2 + \alpha \left\| D \left( \begin{bmatrix} \tilde{\varphi}_1^T[\Omega] \\ \cdots \\ \tilde{\varphi}_i^T[\Omega] \end{bmatrix} \right) \right\|^\kappa \right\}$$

where D is a derivative operator in a frequency domain, and α and κ are parameters for controlling the amount of regularization. The gradient descent optimization technique that can solve the above optimization problem can include a stochastic gradient descent method, a conjugate gradient method, a Nelder-Mead method, a Newton's method, and a stochastic meta gradient method. In other embodiments, the system of linear equations can be solved using a Moore Penrose pseudo inverse matrix, as disclosed previously.

Figure 9A:
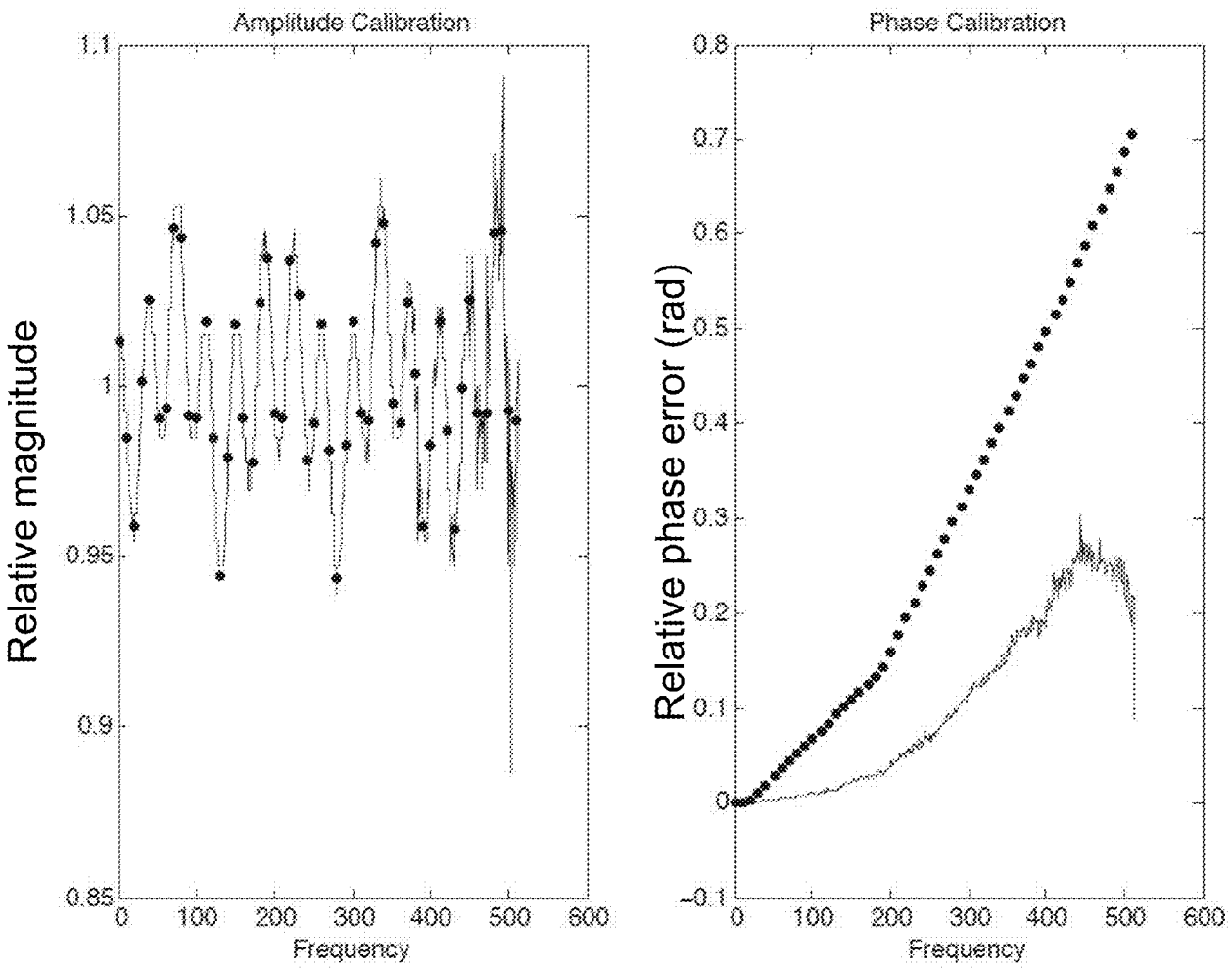
FIGS. 9A-9C illustrate a progression of a magnitude and phase calibration process in accordance with some embodiments.
Figure 9B:
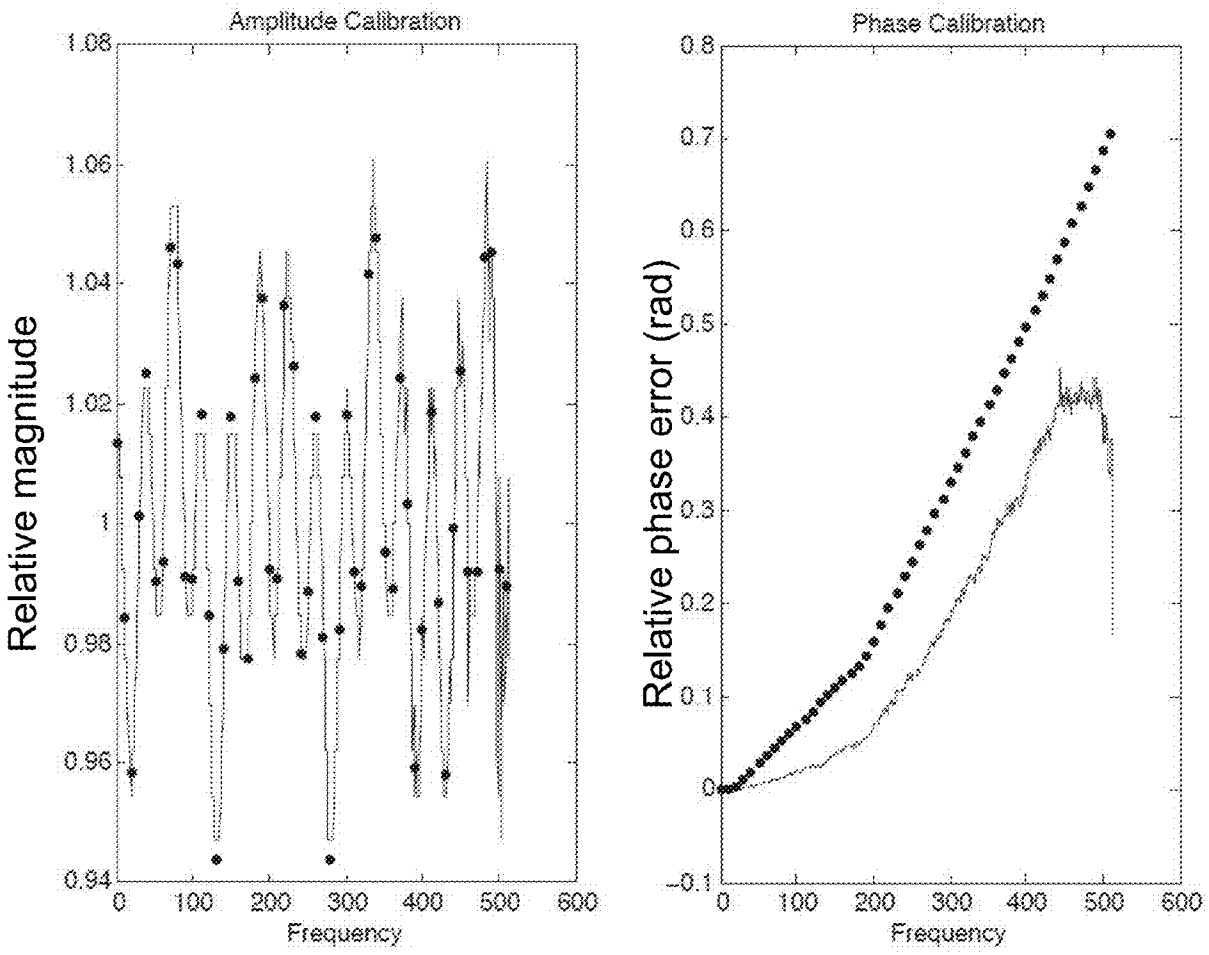
Figure 9C:
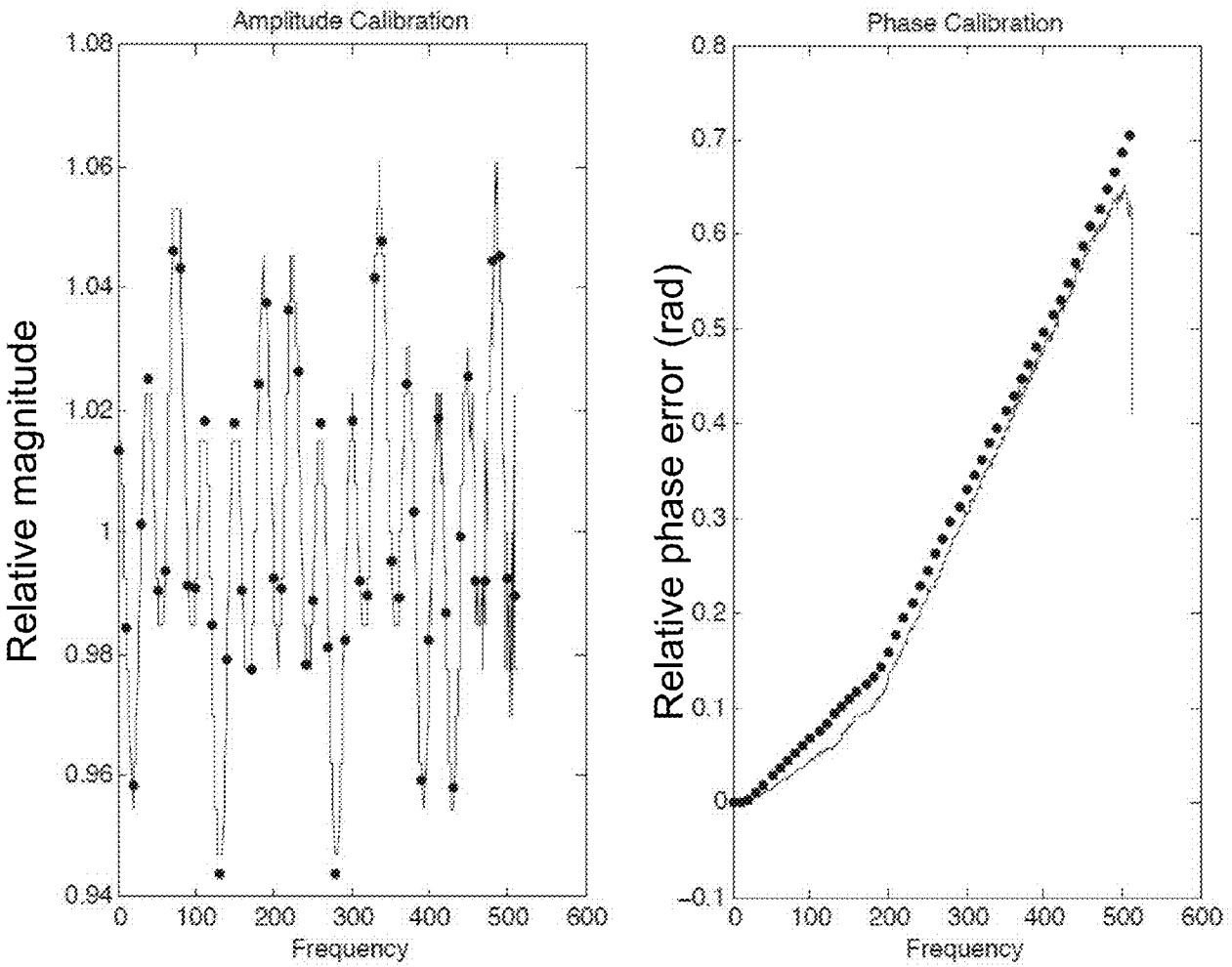

FIGS. 9A-9C illustrate a progression of a magnitude and phase calibration process in accordance with some embodiments. The ground-truth calibration profile is represented using dots, and the estimated calibration profiles are represented using a continuous line. FIG. 9A illustrates the status of estimation when the calibration module 306 is initially turned on. Because the calibration module 306 has not received many data samples, the estimated calibration profile is quite different from the ground-truth calibration profile. However, as the calibration module 306 receives additional data samples over time, as illustrated in FIGS. 9B-9C, the estimated calibration profile becomes more and more accurate.

In some embodiments, the calibration module 306 can compute a different calibration profile for different direction of arrival of acoustic signals. This way, the calibration module 306 can more accurately compensate for the magnitude calibration factor and the relative phase error between two microphones. To do so, the calibration module 306 can label data samples with the DOA estimated by the data preparation module 304, and compute different calibration profiles for each DOA. In some embodiments, the DOAs can be discretized into bins. Therefore, the calibration module 306 can be configured to compute different calibration profiles for each discretized DOA bin, where a discretized DOA bin can include DOAs within a predetermined range. In some embodiments, the calibration module 306 can be configured to compute different calibration profiles for nearby discretized DOA bins (e.g., 2-3 bins whose indices are close to one another).

In some embodiments, the phase calibration module 310 can remove a bias due to direction-dependent phase delays. For example, the phase calibration module 310 can estimate distinct relative phase errors for different DOAs, and subsequently average the distinct relative phase error estimates to determine the final relative phase error. In another example, the phase calibration module 310 can (1) select data samples such that the distribution of the DOA associated with selected samples is a uniform distribution and (2) use only the selected samples to estimate the relative phase error.

In some embodiments, the calibration module 306 can select a reference microphone from a set of (i+1) microphones. In theory, the calibration module 306 can select any one of the (i+1) microphones as a reference microphone.

However, if the randomly selected reference microphone is defective, the calibration process may become unstable. To address this issue, the calibration module 306 can identify an adequate reference microphone from the (i+1) microphones.

In some embodiments, the calibration module 306 can determine whether a new reference microphone should be selected from the "i" microphones. For example, the calibration module 306 can change the reference microphone if the value of the estimated magnitude calibration factor $\tilde{\lambda}_i[\Omega]$ is greater than a predetermined upper threshold or lower than a predetermined lower threshold. In another example, the calibration module 306 can maintain a probabilistic model of an expected calibration profile. If so, the calibration module 306 can use a hypothesis testing method to determine if the calibration module 306 should select a new reference microphone. In this hypothesis testing approach, the calibration module 306 can determine a calibration profile as described above. Then, the calibration module 306 can determine if the determined calibration profile is in accordance with the probabilistic model of an expected calibration profile. If the determine calibration profile is not in accordance with the probabilistic model, then the calibration module 306 can select a new reference microphone.

The disclosed calibration module 306 can be robust even when there are multiple acoustic sources in the scene (e.g., two people talking to one another.) In most cases, the likelihood of different acoustic sources occupying the same time-frequency bin $[n,\Omega]$ is small. Therefore, a TFR sample $M_i[n,\Omega]$ would unlikely correspond to multiple acoustic sources. Even if a TFR sample $M_i[n,\Omega]$ did correspond to multiple acoustic sources, as the $i^{th}$ microphone detects additional TFR samples corresponding to a single acoustic source, the TFR sample $M_i[n,\Omega]$ corresponding to multiple acoustic sources would average out and would not affect the estimated calibration profile in the long run. In some cases, the time-frequency resolution of a TFR sample $M_i[n,\Omega]$ can be adjusted accordingly so that the likelihood of different acoustic sources occupying the same time-frequency bin $[n,\Omega]$ is small.

Once the calibration module 306 re-estimates the magnitude calibration factor $\tilde{\lambda}_i[\Omega]$ and the relative phase error $\phi_i[\Omega]$, the calibration module 306 can provide the calibration profile to the data preparation module 304. Subsequently, as discussed above, the data preparation module 304 can compensate the TFR of incoming signals using the re-estimated calibration profile and provide them to the application module 312. In some embodiments, the calibration module 306 can store the calibration profiles in memory.

Subsequently, the application module 312 can use the calibrated data samples to enable applications. For example, the application module 312 can be configured to perform a blind source separation of acoustic signals. The application module 312 can also be configured to perform speech recognition, to remove background noise from the input stream of signals, to improve the audio quality of input signals, or to perform beam-forming to increase the system's sensitivity to a particular audio source. The application module 312 can be further configured to perform operations disclosed in U.S. Provisional Patent Application Nos. 61/764,290 and 61/788,521, both entitled "SIGNAL SOURCE SEPARATION," which are both herein incorporated by reference in their entirety. For example, the application module 312 can be configured to select data samples from a particular direction of arrival so that only acoustic signals from a particular direction are processed by subsequent blocks in the system. The application module 312 can be configured to perform a probabilistic inference. For example, the application module 312 can be configured to perform belief propagation on a graphical model. In some cases, the graphical model can be a factor graph-based graphical model; in other cases, the graphical model can be a hierarchical graphical model; in yet other cases, the graphical model can be a Markov random field (MRF); in other cases, the graphical model can be a conditional random field (CRF).

Figure 10:
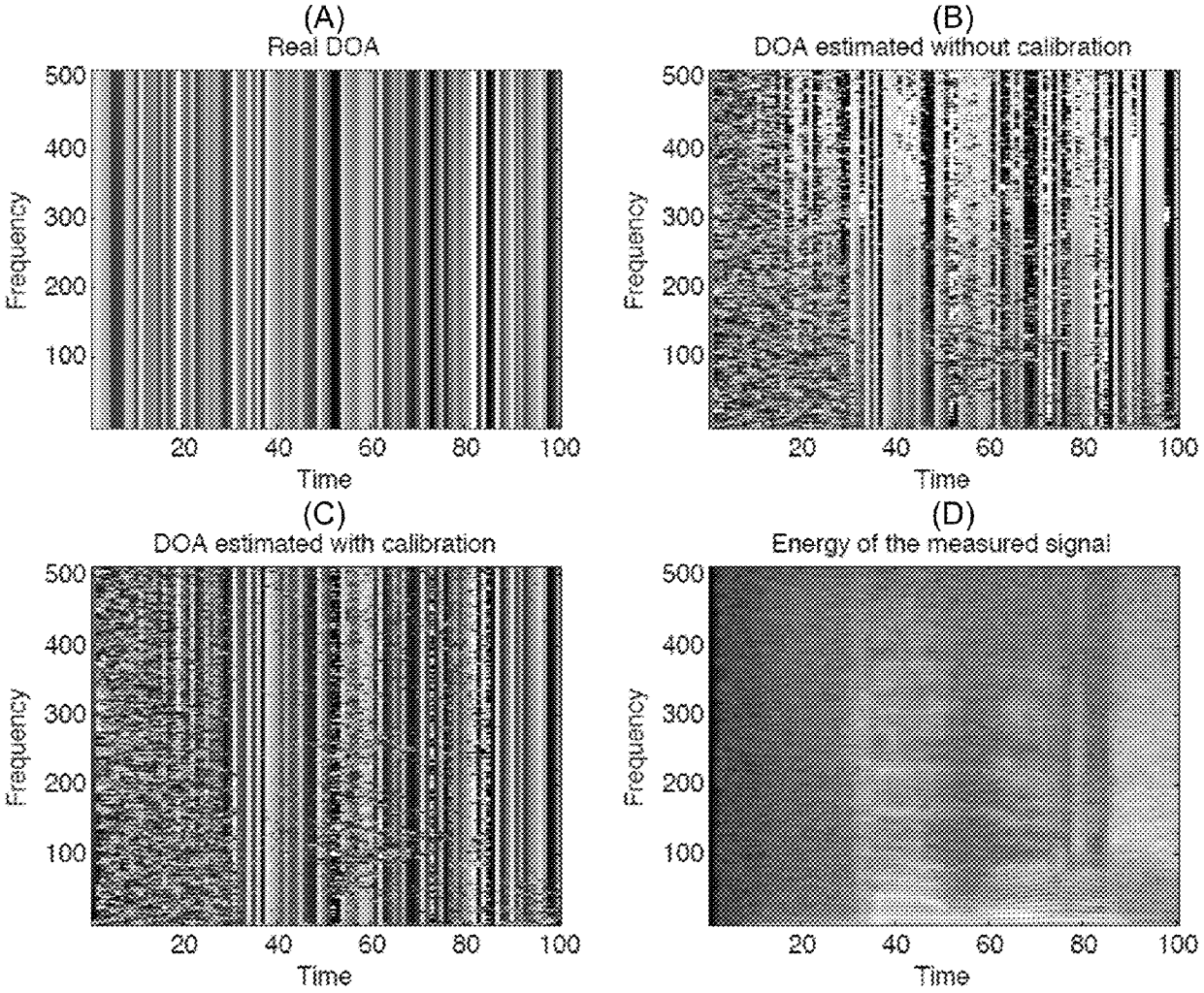
FIGS. 10A-10D illustrate benefits of calibrating microphones using the disclosed calibration mechanism in accordance with some embodiments.

FIGS. 10A-10D illustrate benefits of calibrating microphones using the disclosed calibration mechanism in accordance with some embodiments. FIG. 10A shows the ground-truth direction of arrival (DOA) of an acoustic signal. The brightness of FIG. 10A indicates the DOA in radian. FIG. 10B illustrates the estimated DOA without compensating for the relative phase error between microphones (e.g., without the calibration module 306). FIG. 10C illustrates the estimated DOA by compensating for the relative phase error between microphones (e.g., with the calibration module 306). FIG. 10D illustrates the energy of the signal on which the DOA is estimated.

In general, the DOA estimated without calibration is a lot noisier compared to the DOA estimated with calibration. In fact, the DOA estimated without calibration actually drifts as a function of frequency, which is not observed with the DOA estimated with calibration. Therefore, the proposed calibration of the magnitude calibration factor and the relative phase error is useful for application modules 312.

Also, in general, the DOA estimated with calibration improves as time progresses. This phenomenon illustrates that the calibration profile estimate gets better as the calibration module 304 receives additional data samples over time. The DOA estimates are not as stable when the energy associated with the measured signal is low (e.g., below the noise level of the microphones.) This is because when the signal level is low, there is no signal to estimate the DOA with. In some embodiments, the microphone signals can be denoised using a denoising module before being used by the application module 312.

Figure 11:
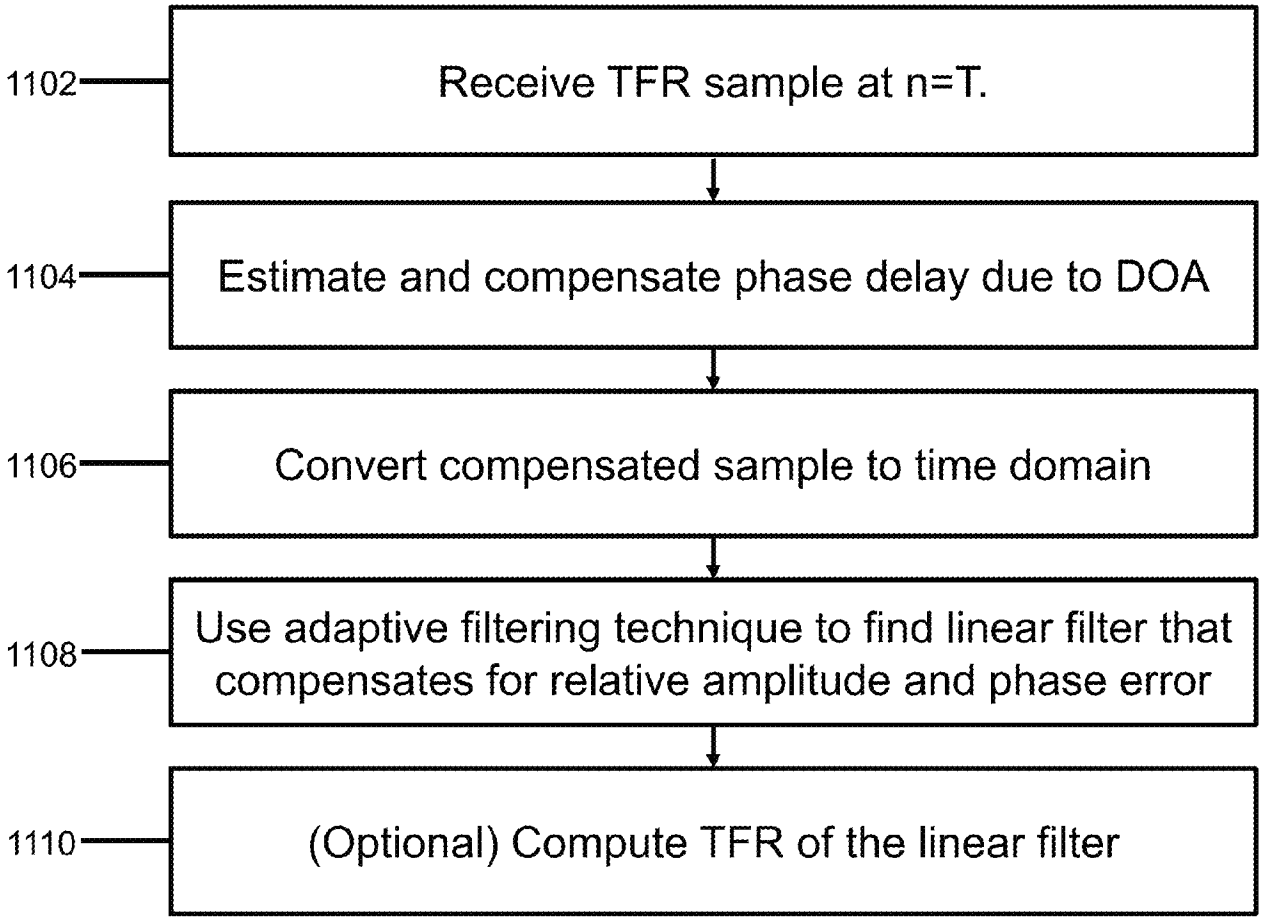
FIG. 11 illustrates a process for estimating a calibration profile using an adaptive filtering technique in accordance with some embodiments.

In some embodiments, the calibration module 306 can estimate the calibration profile $F_i(\Omega)=\lambda_i(\Omega)\exp(i\phi_i(\Omega))$ using an adaptive filtering technique. FIG. 11 illustrates a calibration profile estimation method based on an adaptive filtering technique in accordance with some embodiments. In step 1102, the calibration module 306 can receive a TFR sample at time frame n=T.

In step 1104, the calibration module can estimate the DOA $\theta$ of TFR sample $M_i[n=T,\Omega]$. As discussed above, in some embodiments, the DOA $\theta$ can be estimated using a multiple signal classification (MUSIC) method, an ESPRIT method, or a beam-forming method.

In some embodiments, the DOA $\theta$ of the input acoustic signal can be estimated by solving a system of linear equations:

$$\begin{bmatrix} \eta_1^T[\Omega,\theta] \\ \cdots \\ \eta_i^T[\Omega,\theta] \end{bmatrix} = 2\pi\frac{\Omega f_s}{2P}v\begin{bmatrix} -r_1- \\ \cdots \\ -r_i- \end{bmatrix}\begin{bmatrix} \cos\theta \\ \sin\theta \end{bmatrix},$$

where $\eta_i^T[\Omega,\theta]$ is a relative phase delay between the $i^{th}$ microphone and the reference microphone (e.g., at a time frame T), $f_s$ is a sampling frequency of the ADC 302, $\Omega$ is a bin in the frequency domain, P indicates the number of frequency bins (e.g., the resolution) for the time-frequency transform such as STFT, v is the speed of the acoustic signal, $r_i$ is a two-dimensional vector representing a location of the $i^{th}$ microphone with respect to the reference microphone, and θ is the DOA of the acoustic signal. This system of linear equations can be solved with respect to DOA θ to find the DOA for the input TFR $M_i[n=T,\Omega]$. The DOA for the TFR sample $M_i[n=T,\Omega]$ can be represented as $\theta^T$. The relative phase delay $\eta_i^T[\Omega,\theta]$ can be measured or estimated using techniques disclosed above with respect to FIGS. 4, 8; the DOA $\theta^T$ can be estimated using techniques disclosed above with respect to FIGS. 4, 8.

Subsequently, the calibration module 306 can compensate the TFR sample $M_i[n=T,\Omega]$ for the relative phase delay due to DOA $\theta^T$. The compensated TFR sample, $\hat{M}_i[n=T,\Omega]$, can be computed as follows:

$$\hat{M}_i[n=T,\Omega]=M_i[n=T,\Omega]\times\exp\left\{i2\pi\frac{\Omega f_s}{2P}v[-r_i\ -]\begin{bmatrix}\cos\theta^T\\ \sin\theta^T\end{bmatrix}\right\}.$$

If all microphones have the same magnitude response and the same phase response (e.g., zero relative phase error,) then the compensated TFR sample, $\hat{M}_i[n=T,\Omega]$, should be identical for all microphones. Any difference in the compensated TFR sample can be attributed to the magnitude calibration factor and the relative phase error.

In step 1106, the calibration module 306 can convert the compensated TFR samples, $\hat{M}_i[n=T,\Omega]$, to time-domain signals, $\hat{m}_i(t)$. For example, the calibration module 306 an operate an inverse time-frequency transform on the compensated TFR samples.

In step 1108, the calibration module 306 can determine a linear filter $g_i(t)$ that maps the time-domain signal $\hat{m}_i(t)$ of $i^{th}$ microphone to the time-domain signal $\hat{m}_R(t)$ of the reference microphone:

$$\hat{m}_R(t)=g_i(t)\otimes\hat{m}_i(t)$$

where ⊗ represents a convolution operator. This way, the linear filter $g_i(t)$ can take into account any relative phase sensitivity and any relative phase error between the $i^{th}$ microphone and the reference microphone. The calibration module 306 can compute the linear filter $g_i(t)$ for i microphones in a microphone array having (i+1) microphones.

In some embodiments, the calibration module 306 can identify such a linear filter $g_i(t)$ using an adaptive filtering technique. The adaptive filtering technique can include a least mean squares filtering technique, a recursive least squares filter technique, a multi-delay block frequency domain adaptive filter technique, a kernel adaptive filter technique, and/or a Wiener Hopf-method. Adaptive filtering techniques used in acoustic echo cancellation application can also be used to identify such a linear filter $g_i(t)$.

In some embodiments, the calibration profile can be represented as the linear filter $g_i(t)$. In other embodiments, the calibration profile can be represented as a TFR of the linear filter $g_i(t)$. To this end, in step 1110, the calibration module 306 can optionally compute the TRF of the linear filter $g_i(t)$.

In some embodiments, the calibration module 306 can be configured to reduce the amount of computation by interpolating calibration factors across different frequencies. The calibration module 306 can be configured to maintain a mapping between (1) a magnitude calibration factor and/or a relative phase error for a set of frequencies and (2) a magnitude calibration factor and/or a relative phase error for frequencies not included in the set of frequencies.

During the calibration session, the calibration module 306 can be configured to determine the magnitude calibration factor and/or the relative phase error for the set of frequencies. Then, instead of also determining the magnitude calibration factor and/or the relative phase error for frequencies not included in the set of frequencies, the calibration module 306 can use the mapping to estimate the magnitude calibration factor and/or the relative phase error for the frequencies not included in the set of frequencies. This way, the calibration module 306 can reduce the amount of computation needed to determine magnitude calibration factors and/or relative phase errors for all frequencies of interest. In some cases, the set of frequencies for which the calibration module 306 determines the magnitude calibration factors and/or the relative phase errors can include as little as one frequency.

In some embodiments, the calibration module 306 can be configured to determine the mapping using a regression function. In some cases, the regression function can be configured to estimate, based on the magnitude calibration factor and/or the relative phase error for the set of frequencies, one or more parameters for a spline curve that approximates the magnitude calibration factors and/or the relative phase errors for frequencies that are not included in the set of frequencies. In other cases, the regression function can be configured to estimate, based on the magnitude calibration factor and/or the relative phase error for the set of frequencies, the actual values of the magnitude calibration factors and/or the relative phase errors for each frequency not in the set of frequencies.

Figure 12:
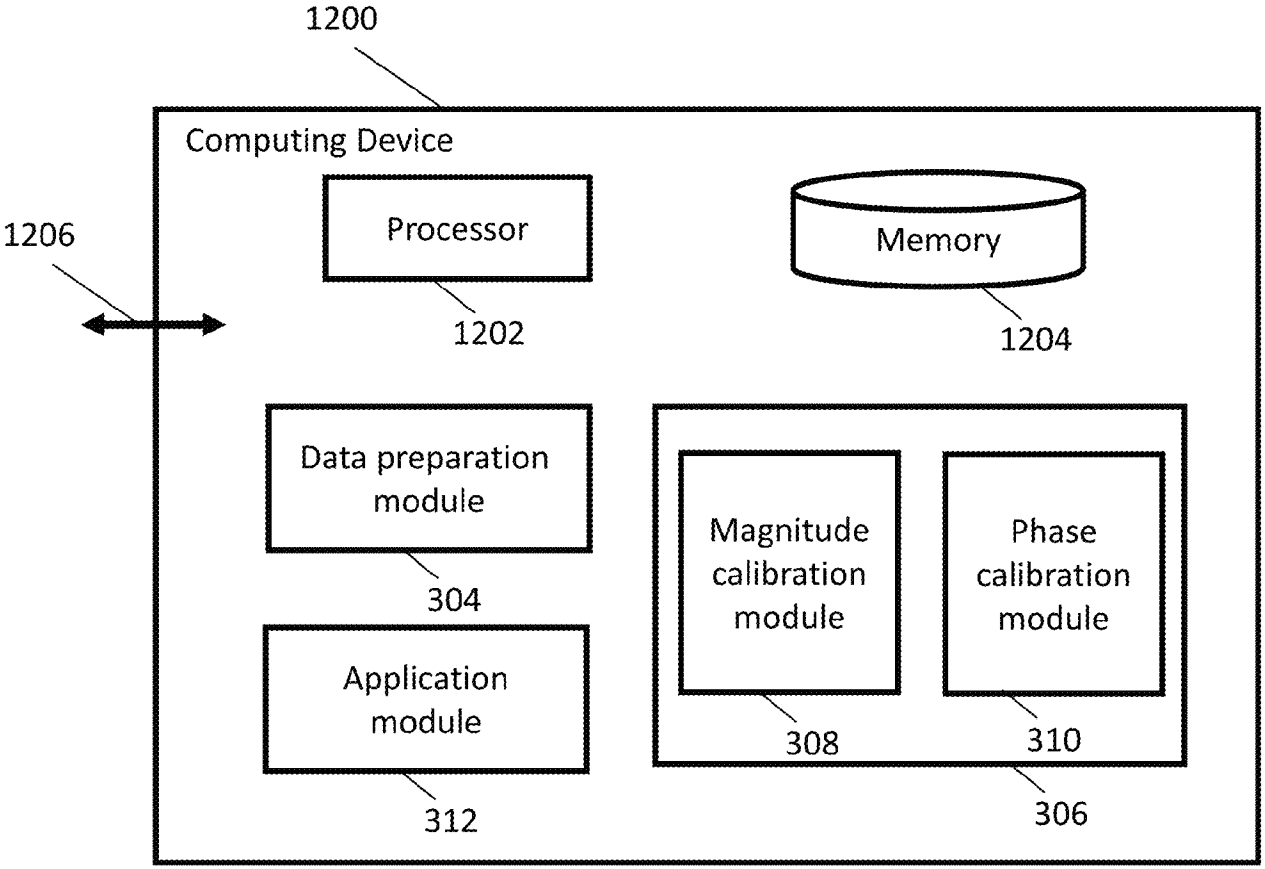
FIG. 12 is a block diagram of a computing device in accordance with some embodiments.

The disclosed apparatus and systems can include a computing device. FIG. 12 is a block diagram of a computing device in accordance with some embodiments. The block diagram shows a computing device 1200, which includes a processor 1202, memory 1204, one or more interfaces 1206, a data preparation module 304, a calibration module 306 having a magnitude calibration module 308 and a phase calibration module 310, and an application module 312. The computing device 1200 may include additional modules, less modules, or any other suitable combination of modules that perform any suitable operation or combination of operations.

The computing device 1200 can communicate with other computing devices (not shown) via the interface 1206. The interface 1206 can be implemented in hardware to send and receive signals in a variety of mediums, such as optical, copper, and wireless, and in a number of different protocols some of which may be non-transient.

In some embodiments, one or more of the modules 304, 306, 308, 310, and 312 can be implemented in software using the memory 1204. The memory 1204 can also maintain calibration profiles of microphones. The memory 1204 can be a non-transitory computer readable medium, flash memory, a magnetic disk drive, an optical drive, a programmable read-only memory (PROM), a read-only memory (ROM), or any other memory or combination of memories. The software can run on a processor 1202 capable of executing computer instructions or computer code. The processor 1202 might also be implemented in hardware using an application specific integrated circuit (ASIC), programmable logic array (PLA), digital signal processor(DSP), field programmable gate array (FPGA), or any other integrated circuit.

One or more of the modules 304, 306, 308, 310, and 312 can be implemented in hardware using an ASIC, PLA, DSP, FPGA, or any other integrated circuit. In some embodiments, two or more modules 304, 306, 308, 310, and 312 can be implemented on the same integrated circuit, such as ASIC, PLA, DSP, or FPGA, thereby forming a system on chip.

In some embodiments, the computing device 1200 can include user equipment. The user equipment can communicate with one or more radio access networks and with wired communication networks. The user equipment can be a cellular phone having phonetic communication capabilities. The user equipment can also be a smart phone providing services such as word processing, web browsing, gaming, e-book capabilities, an operating system, and a full keyboard. The user equipment can also be a tablet computer providing network access and most of the services provided by a smart phone. The user equipment operates using an operating system such as Symbian OS, iPhone OS, RIM's Blackberry, Windows Mobile, Linux, HP WebOS, and Android. The screen might be a touch screen that is used to input data to the mobile device, in which case the screen can be used instead of the full keyboard. The user equipment can also keep global positioning coordinates, profile information, or other location information.

The computing device 1200 can also include any platforms capable of computations and communication. Non-limiting examples can include televisions (TVs), video projectors, set-top boxes or set-top units, digital video recorders (DVR), computers, netbooks, laptops, and any other audio/visual equipment with computation capabilities. The computing device 1200 can be configured with one or more processors that process instructions and run software that may be stored in memory. The processor also communicates with the memory and interfaces to communicate with other devices. The processor can be any applicable processor such as a system-on-a-chip that combines a CPU, an application processor, and flash memory. The computing device 1200 can also provide a variety of user interfaces such as a keyboard, a touch screen, a trackball, a touch pad, and/or a mouse. The computing device 1200 may also include speakers and a display device in some embodiments.

The computing device 1200 can also include a bio-medical electronic device. The bio-medical electronic device can include a hearing aid. The computing device 1200 can be a consumer device (e.g., on a television set, or a microwave oven) and the calibration module can facilitate enhanced audio input for voice control. In some embodiments, the computing device 1200 can be integrated into a larger system to facilitate audio processing. For example, the computing device 1200 can be a part of an automobile, and can facilitate human-human and/or human-machine communication.

Figure 13A:
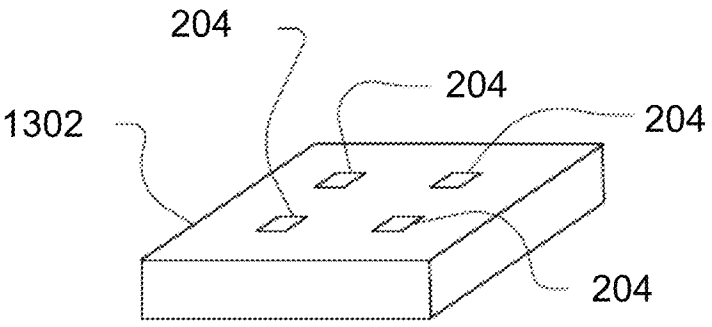
FIGS. 13A-13B illustrate a set of microphones that can be used in conjunction with the disclosed calibration process in accordance with some embodiments.
Figure 13B:
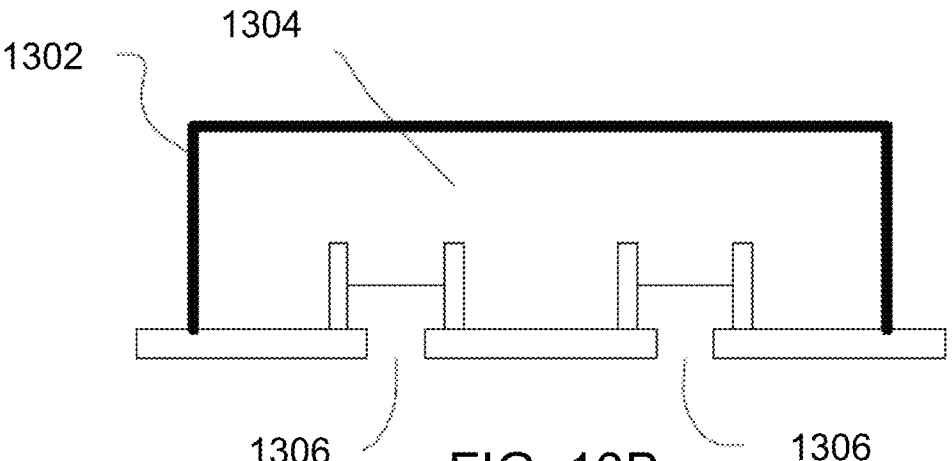

FIGS. 13A-13B illustrate a set of microphones that can be used in conjunction with the disclosed calibration process in accordance with some embodiments. The set of microphones can be placed on a microphone unit 1302. The microphone unit 1302 can include a plurality of microphones 204. Each microphone can include a MEMS element 1306 that is coupled to one of four ports arranged in a 1.5 mm-2 mm square configuration. The MEMS elements from the plurality of microphones can share a common backvolume 1304. Optionally, each element can use an individual partitioned backvolume.

More generally, a microphone includes multiple ports, multiple elements each coupled to one or more ports, and possible coupling between the ports (e.g., with specific coupling between ports or using one or more common backvolumes). Such more complex arrangements may combine physical directional, frequency, and/or noise cancellation characteristics to provide suitable inputs for further processing.

In some embodiments, the microphone unit 1302 can also include one or more of the data preparation module 304, the magnitude calibration module 308, and the phase calibration module 310. This way, the microphone unit 1302 can become a self-calibrating microphone unit that can be coupled to computing systems without requiring the computing systems to calibrate audio data from the microphone unit 1302. In some cases, the data preparation module 304, the magnitude calibration module 308, and/or the phase calibration module 310 in the microphone unit 1302 can be implemented as a hard-wired system. In other cases, the data preparation module 304, the magnitude calibration module 308, and the phase calibration module 310 in the microphone unit 1302 can be configured to cause a processor to perform the method steps associated with the respective modules. In some cases, the microphone unit 1302 can also include the application module 312, thereby providing an intelligent microphone unit.

The microphone unit 1302 can communicate with other devices using an interface. The interface can be implemented in hardware to send and receive signals in a variety of mediums, such as optical, copper, and wireless, and in a number of different protocols some of which may be non-transient.

It is to be understood that the disclosed subject matter is not limited in its application to the details of construction and to the arrangements of the components set forth in the following description or illustrated in the drawings. The disclosed subject matter is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the disclosed subject matter. It is important, therefore, that the claims be regarded as including such equivalent constructions insofar as they do not depart from the spirit and scope of the disclosed subject matter. For example, some of the disclosed steps may be performed by relating one or more variables. This relationship may be expressed using a mathematical equation. However, one of ordinary skill in the art may also express the same relationship between the one or more variables using a different mathematical equation by transforming the disclosed mathematical equation. It is important that the claims be regarded as including such equivalent relationships between the one or more variables.

Although the disclosed subject matter has been described and illustrated in the foregoing exemplary embodiments, it is understood that the present disclosure has been made only by way of example, and that numerous changes in the details of implementation of the disclosed subject matter may be made without departing from the spirit and scope of the disclosed subject matter.

The invention claimed is:

1. An apparatus comprising:

an interface configured to receive a first digitized signal stream and a second digitized signal stream, wherein the first digitized signal stream and the second digitized signal stream correspond to an acoustic signal captured by a first microphone and a second microphone, respectively;

a processor, in communication with the interface, configured to run a module stored in memory, wherein the module is configured to:

determine a first time-frequency representation of the first digitized signal stream and a second time-frequency representation of the second digitized signal stream, wherein the first time-frequency representation indicates a magnitude of the first digitized signal stream for a plurality of frequencies at a plurality of time frames, and wherein the second time-frequency representation indicates a magnitude of the second digitized signal stream for the plurality of frequencies for the plurality of time frames;

determine a relationship between the first time-frequency representation and the second time-frequency representation at the plurality of time frames for a first of the plurality of frequencies; and determine a magnitude calibration factor between the first microphone and the second microphone for the first of the plurality of frequencies based on the relationship between the first time-frequency representation and the second time-frequency representation.

2. The apparatus of claim 1, wherein the module is configured to determine the relationship between the first time-frequency representation and the second time-frequency representation by:

determining, for the first of the plurality of frequencies, ratios of the second time-frequency representation to the first time-frequency representation for each of the plurality of time frames; and determining a histogram of the ratios corresponding to the first of the plurality of frequencies.

3. The apparatus of claim 2, wherein the module is configured to determine the magnitude calibration factor based on a count of the ratios in the histogram.

4. The apparatus of claim 3, wherein the module is further configured to:

determine a plurality of magnitude calibration factors corresponding to a plurality of frequencies based on a plurality of histograms, wherein the plurality of histograms corresponds to the plurality of frequencies, respectively; and smooth magnitude calibration factors associated with at least two of the plurality of frequencies.

5. The apparatus of claim 3, wherein the module is configured to determine the magnitude calibration factor for the first of the plurality of frequencies by identifying a ratio with the highest count in the histogram.

6. The apparatus of claim 1, wherein the module is configured to determine the relationship by identifying a line that models the relationship between the first time-frequency representation and second time-frequency representation corresponding to the plurality of time frames and the first of the plurality of frequencies.

7. The apparatus of claim 1, wherein the module is configured to multiply the first time-frequency representation for the first of the plurality of frequencies with the magnitude calibration factor for the first of the plurality of frequencies to calibrate the first microphone with respect to the second microphone.

8. The apparatus of claim 1, wherein the module is further configured to:

receive a first additional digitized signal of the first digitized signal stream corresponding to the acoustic signal captured by the first microphone at a first time frame;

receive a second additional digitized signal of the second digitized signal stream corresponding to the acoustic signal captured by the second microphone at the first time frame;

compute a third time-frequency representation based on the first additional digitized signal;

compute a fourth time-frequency representation based on the second additional digitized signal; and update the magnitude calibration factor based on the third time-frequency representation and the fourth time-frequency representation.

9. The apparatus of claim 8, wherein the module is configured to:

identify a frequency at which the magnitude of the third time-frequency representation at the first time frame is below a noise level, and discard the third time-frequency representation for the identified frequency and the first time frame when updating the magnitude calibration factor based on the third time-frequency representation.

10. The apparatus of claim 8, wherein the module is configured to:

identify a frequency at which the third time-frequency representation at the first time frame is associated with a non-conforming acoustic signal;

discard the third time-frequency representation for the identified frequency and the first time frame when updating the magnitude calibration factor based on the third time-frequency representation.

11. The apparatus of claim 10, wherein the module is configured to determine that the third time-frequency representation is associated with the non-conforming acoustic signal when a ratio of the fourth time-frequency representation and the third time-frequency representation is sufficiently different from the magnitude calibration factor computed based on the first time-frequency representation and the second time-frequency representation.

12. The apparatus of claim 1, wherein the time-frequency representation comprises one or more of a short-time Fourier transform (STFT) or a wavelet transform.

13. A method comprising:

receiving, by a data processing module coupled to a first microphone and a second microphone, a first digitized signal stream and a second digitized signal stream, wherein the first digitized signal stream and the second digitized signal stream correspond to an acoustic signal captured by the first microphone and the second microphone, respectively;

determining, by the data processing module, a first time-frequency representation of the first digitized signal stream and a second time-frequency representation of the second digitized signal stream, wherein the first time-frequency representation indicates a magnitude of the first digitized signal stream for a plurality of frequencies at a plurality of time frames, and wherein the second time-frequency representation indicates a magnitude of the second digitized signal stream for the plurality of frequencies for the plurality of time frames;

determining, by a calibration module in communication with the data processing module, a relationship between the first time-frequency representation and the second time-frequency representation at the plurality of time frames for a first of the plurality of frequencies; and determining, by the calibration module, a magnitude calibration factor between the first microphone and the second microphone for the first of the plurality of frequencies based on the relationship between the first time-frequency representation and the second time-frequency representation.

14. The method of claim 13, wherein determining the relationship between the first time-frequency representation and the second time-frequency representation comprises:

determining, for the first of the plurality of frequencies, ratios of the second time-frequency representation to the first time-frequency representation for each of the plurality of time frames; and determining a histogram of the ratios corresponding to the first of the plurality of frequencies.

15. The method of claim 13, wherein determining the relationship between the first time-frequency representation and the second time-frequency representation comprises identifying a line that models the relationship between the first time-frequency representation and second time-frequency representation corresponding to the plurality of time frames and the first of the plurality of frequencies.

16. The method of claim 13, further comprising multiplying the first time-frequency representation for the first of the plurality of frequencies with the magnitude calibration factor for the first of the plurality of frequencies to calibrate the first microphone with respect to the second microphone.

17. The method of claim 13, further comprising:

receiving a first additional digitized signal of the first digitized signal stream corresponding to the acoustic signal captured by the first microphone at a first time frame;

receiving a second additional digitized signal of the second digitized signal stream corresponding to the acoustic signal captured by the second microphone at the first time frame;

computing a third time-frequency representation based on the first additional digitized signal;

computing a fourth time-frequency representation based on the second additional digitized signal; and updating the magnitude calibration factor based on the third time-frequency representation and the fourth time-frequency representation.

18. A non-transitory computer readable medium having executable instructions operable to cause a data processing apparatus to:

receive, over an interface coupled to a first microphone and a second microphone, a first digitized signal stream and a second digitized signal stream, wherein the first digitized signal stream and the second digitized signal stream correspond to an acoustic signal captured by the first microphone and the second microphone, respectively;

determine a first time-frequency representation of the first digitized signal stream and a second time-frequency representation of the second digitized signal stream, wherein the first time-frequency representation indicates a magnitude of the first digitized signal stream for a plurality of frequencies at a plurality of time frames, and wherein the second time-frequency representation indicates a magnitude of the second digitized signal stream for the plurality of frequencies for the plurality of time frames;

determine a relationship between the first time-frequency representation and the second time-frequency representation at the plurality of time frames for a first of the plurality of frequencies; and determine a magnitude calibration factor between the first microphone and the second microphone for the first of the plurality of frequencies based on the relationship between the first time-frequency representation and the second time-frequency representation.

19. The non-transitory computer readable medium of claim 18, wherein the executable instructions are operable to cause the data processing apparatus to identify a line that models the first time-frequency representation and second time-frequency representation corresponding to the plurality of time frames.

20. The non-transitory computer readable medium of claim 18, wherein the executable instructions are operable to cause the data processing apparatus to:

receive a first additional digitized signal of the first digitized signal stream corresponding to the acoustic signal captured by the first microphone at a first time frame;

receive a second additional digitized signal of the second digitized signal stream corresponding to the acoustic signal captured by the second microphone at the first time frame;

compute a third time-frequency representation based on the first additional digitized signal;

compute a fourth time-frequency representation based on the second additional digitized signal; and update the magnitude calibration factor based on the third time-frequency representation and the fourth time-frequency representation.

* * * * *